US008682744B2

(12) United States Patent
Emura

(10) Patent No.: US 8,682,744 B2
(45) Date of Patent: Mar. 25, 2014

(54) ELECTRONIC MAIL SENDING DEVICE, SEND TIME SETTING METHOD, SEND TIME SETTING PROGRAM, AND RECORDING MEDIUM

(75) Inventor: Sadaaki Emura, Shinagawa-ku (JP)

(73) Assignee: Rakuten, Inc., Tokyo (JP)

( * ) Notice: Subject to any disclaimer, the term of this patent is extended or adjusted under 35 U.S.C. 154(b) by 0 days.

(21) Appl. No.: 13/819,512

(22) PCT Filed: Aug. 29, 2011

(86) PCT No.: PCT/JP2011/069417

§ 371 (c)(1),
(2), (4) Date: Feb. 27, 2013

(87) PCT Pub. No.: WO2012/029702

PCT Pub. Date: Mar. 8, 2012

(65) Prior Publication Data

US 2013/0166666 A1 Jun. 27, 2013

(30) Foreign Application Priority Data

Aug. 30, 2010 (JP) ..... 2010-191758

(51) Int. Cl.
*G06Q 30/00* (2012.01)

(52) U.S. Cl.
USPC ..... 705/26.3; 705/26.1

(58) Field of Classification Search
USPC ..... 705/26.3, 26.1
See application file for complete search history.

(56) References Cited

U.S. PATENT DOCUMENTS

2006/0218070 A1* 9/2006 Lange ..... 705/37
2007/0279247 A1* 12/2007 Rye et al. ..... 340/825.72
2009/0152343 A1* 6/2009 Carter et al. ..... 235/379

FOREIGN PATENT DOCUMENTS

JP 2001-319118 A 11/2001
JP 2007-4781 A 1/2007
JP 2009-258781 A 11/2009
JP 2010-134969 A 6/2010

OTHER PUBLICATIONS

Anon., "Six Education Execs Face Graft Charges," Manila Standard, May 11, 2006.*
Anon., "Process of Purchasing Fighter Aircraft Delayed by 2 Months," Indian Express, Feb. 27, 2008.*

* cited by examiner

*Primary Examiner* — Nicholas D Rosen
(74) *Attorney, Agent, or Firm* — Sughrue Mion, PLLC

(57) ABSTRACT

An electronic mail such as a remind mail is sent at a timing which encourages bidding on an auction to apply to purchase a product. An electronic mail sending device sends a first electronic mail which notifies a user of a terminal device of a first application deadline in a transaction for which the first application deadline to purchase a product is set, and which includes link information to a webpage which lists information about the product to be traded, decides whether or not the application information is received by the first application deadline, compares the access time to the webpage and the reference time, and when the access time comes later than the reference time, makes a relative send time of a second electronic mail to be sent next come earlier than a relative send time of the first electronic mail which has already been sent.

15 Claims, 10 Drawing Sheets

FIG.3A

MEMBER INFORMATION DB

| |
|---|
| USER ID |
| PASSWORD |
| NAME |
| DATE OF BIRTH |
| SEX |
| ADDRESS |
| TELEPHONE NUMBER |
| ELECTRONIC MAIL ADDRESS |
| . . . |

FIG.3B

AUCTION INFORMATION DB

| |
|---|
| AUCTION ID |
| SELLER USER ID |
| PRODUCT NAME |
| DESCRIPTION |
| START PRICE |
| AUCTION START DATE AND TIME |
| AUCTION END DATE AND TIME |
| WATCH LIST REGISTERED USER ID LIST |
| . . . |

FIG.3C

WATCH LIST DB

| |
|---|
| USER ID |
| REGISTERED AUCTION INFORMATION |
| REMIND MAIL RELATIVE SEND TIME |
| DATE AND TIME RECORD INFORMATION |

FIG.3D

REGISTERED AUCTION INFORMATION

| |
|---|
| AUCTION ID |
| REMIND MAIL SENDING SCHEDULED DATE AND TIME |
| AUCTION END SCHEDULED DATE AND TIME |
| REMIND MAIL SEND FLAG |

FIG.3E

DATE AND TIME RECORD INFORMATION

| |
|---|
| AUCTION ID |
| MESSAGE ID |
| REMIND MAIL SEND DATE AND TIME |
| REMIND MAIL OPENING DATE AND TIME |

FIG.3F

HISTORY DB

| |
|---|
| ACCESS HISTORY |
| BIDDING HISTORY |
| . . . |

FIG.3G

ACCESS HISTORY

| |
|---|
| AUCTION ID |
| ACCESS DATE AND TIME |
| URL |
| USER ID |

FIG.3H

BIDDING HISTORY

| |
|---|
| AUCTION ID |
| BIDDING DATE AND TIME |
| USER ID |
| BID |

FIG.10A

RECEIVED MAIL DB

| USER ID |
| --- |
| MESSAGE ID |
| RECEIVED MAIL |
| MAIL OPENING DATE AND TIME |

FIG.10B

DATE AND TIME RECORD INFORMATION

| AUCTION ID |
| --- |
| MESSAGE ID |

ELECTRONIC MAIL SENDING DEVICE, SEND TIME SETTING METHOD, SEND TIME SETTING PROGRAM, AND RECORDING MEDIUM

CROSS REFERENCE TO RELATED APPLICATIONS

This application is a National Stage of International Application No. PCT/JP2011/069417 filed Aug. 29, 2011, claiming priority based on Japanese Patent Application No. 2010-191758 filed Aug. 30, 2010, the contents of all of which are incorporated herein by reference in their entirety.

TECHNICAL FIELD

The present invention relates to a technology of an electronic mail sending device which sends an electronic mail which notifies an application deadline in transaction for which the application deadline to purchase a product is set, a send time setting method, and a send time setting program of the electronic mail.

BACKGROUND ART

Conventionally, transaction for which an application deadline to purchase a product is set is known in electronic commerce. A form of such transaction includes, for example, an auction, group purchase and a time sale. To purchase a product, it is necessary to bid on, place an order and apply for the product by the deadline set in advance. In this transaction form, service which reminds a user to apply for purchase by an application deadline is provided in some cases. For example, at a website of electronic commerce, the user can register a favorite product in, for example, a list referred to as a "watch list". When the application deadline to purchase the product registered in the watch list nears, an electronic mail which is referred to as a remind mail (reminder mail) is sent to the user registered the product in the watch list. In case of, for example, an auction, an end date and time of the auction is described in the remind mail as the application deadline. The user can learn that the application deadline to purchase the product registered in the watch list nears by reading this remind mail.

Conventionally, a send timing of this remind mail is, for example, determined in advance a predetermined time before the application deadline, or can be set by the user. Meanwhile, Patent Literature 1 discloses a technique of, at a system side, setting a send timing of remind mail for product sales. More specifically, a product sales system disclosed in Patent Literature 1 sends a remind mail a little before a consumption cycle of the product passes based on a shipping date of the product ordered in the past from a client and a consumption cycle of the product.

CITATION LIST

Patent Literature

Patent Literature 1: JP 2001-319118 A

SUMMARY OF THE INVENTION

Problem to be Solved by the Invention

However, when the technique disclosed in Patent Literature 1 is applied to set a send timing of a remind mail in transaction for which an application deadline to purchase a product is set, the remind mail is not necessarily sent at an adequate timing. Depending on, for example, a relationship between a send timing of a remind mail and a timing when an application deadline comes, a user may hesitate to apply for purchase in some cases.

Hence, the present invention is made in light of the above, and an object is to provide an electronic mail sending device, a send time setting method, a send time setting program and a recording medium which can send an electronic mail such as a remind mail at a timing which can encourage an application to purchase a product.

Means for Solving the Problem

The invention according to claim 1 is an electronic mail sending device comprising:

a sending means that sends an electronic mail which notifies an application deadline in transaction for which the application deadline to purchase a product is set, and which includes link information to a webpage which lists information about the product to be traded;

an access information receiving means that receives access information which indicates an access to the webpage indicated by the link information included in the electronic mail, from a terminal device;

an application information receiving means that receives application information which indicates an application to purchase the product whose information is listed in the webpage, from the terminal device;

a first deciding means that decides whether or not the application information receiving means receives the application information by the application deadline;

a first comparing means that compares an access time to the webpage indicated by a reception time of the access information by the access information receiving means, and a first time set in advance; and a setting means that, when the first deciding means decides that the application information is not received by the application deadline, and when the access time comes later than the first time as a result of the comparison by the first comparing means, makes a first send time which is a send time of the electronic mail to be sent next by the sending means and which is relative to the application deadline notified by the electronic mail, come earlier than a second send time which is a send time of the electronic mail sent by the sending means and which is relative to the application deadline notified by the electronic mail.

When an access to a webpage which lists information about a product is late and purchase of this product is not applied for, it is assumed that the time to the application deadline to purchase the product is short, and therefore the user didn't have much time to think about whether or not to apply to purchase a product even though the user accesses a webpage. In this case, the present invention can make a relative send time of an electronic mail come early, so that the user is more likely to access the webpage relatively early. Consequently, it is possible to give the user the time to think about whether or not to apply to purchase a product. Consequently, it is possible to encourage the user to apply to purchase the product.

The invention according to claim 2 is the electronic mail sending device according to claim 1, wherein, when it is decided that the application information is not received by the application deadline, and when the access time comes later than the first time, the setting means makes the first send time come earlier than the second send time by a period of time corresponding to or more than the difference between the access time and the first time.

The present invention can more reliably give a time to think about whether or not to apply to purchase a product.

The invention according to claim 3 is the electronic mail sending device according to claim 1 or 2, further comprising:

a second comparing means that, when it is decided the application information is not received by the application deadline, and when the access time comes earlier than the first time, compares the access time and time which comes a preset first period of time before the first time, wherein, when the access time comes earlier than time which comes the first period of time before the first time as a result of the comparison by the second comparing means, the setting means makes the first send time come later than the second send time.

When an access to a webpage which lists information about a product is early and purchase of this product is not applied for, it is considered that the time to the application deadline to purchase the product is long, and therefore the user has too much time to think about whether or not to apply to purchase a product and does not feel impatient about applying for purchase. In this case, the present invention can make a relative send time of an electronic mail come late, so that the user is more likely to access a webpage relatively late. Consequently, it is possible to make the user feel impatient about applying to purchase a product while giving the user the time to think about whether or not to apply to purchase a product. Consequently, it is possible to encourage the user to apply to purchase the product.

The invention according to claim 4 is the electronic mail sending device according to claim 3, wherein, when the access time comes earlier than time which comes the first period of time before the first time, the setting means makes the first send time come later than the second send time by a period of time corresponding to or more than the difference between the time which comes the first period of time before the first time, and the access time.

The present invention can more reliably make the user feel impatient about applying to purchase the product.

The invention according to claim 5 is the electronic mail sending device according to any one of claims 1 to 4, further comprising:

a first calculating means that calculates a time from the access to the webpage to the application to purchase the product, based on a history of a user of an address of the electronic mail sent by the sending means, among histories stored in a memory means that stores a history of an access to a webpage which lists information about the product to be traded and a history of an application to purchase a product; and a first time setting means that sets, as the first time, time which comes the time calculated by the first calculating means or more before the application deadline notified by the electronic mail sent by the sending means, wherein:

the first comparing means compares the access time and the first time set by the first time setting means; and the setting means sets the first send time of the electronic mail in which an address of a user matches with the electronic mail sent by the sending means.

The present invention sets as a first time a time which comes the time required from an access to the webpage to an application for purchase before the application deadline. Consequently, it is possible to accurately decide whether or not the user has a time to think about whether or not to apply to purchase a product.

The invention according to claim 6 is the electronic mail sending device according to any one of claims 1 to 5, further comprising:

a second calculating means that calculates a time from the access to the webpage to the application to purchase the product, based on a history of a product whose type matches with the product whose application deadline is notified by the electronic mail sent by the sending means, among histories stored in a memory means that stores a history of an access to a webpage which lists information about the product to be traded and a history of an application to purchase a product; and a second time setting means that sets, as the first time, time which comes the time calculated by the second calculating means or more before the application deadline notified by the electronic mail sent by the sending means, wherein:

the first comparing means compares the access time and the first time set by the second time setting means; and the setting means sets the first send time of the electronic mail in which a type of a product whose application deadline is notified matches with the electronic mail sent by the sending means.

The present invention sets as a first time a time which comes the time required from an access to the webpage to an application for purchase before the application deadline. Consequently, it is possible to accurately decide whether or not the user has a time to think about whether or not to apply to purchase a product.

The invention according to claim 7 is the electronic mail sending device according to any one of claims 1 to 6, further comprising:

a second deciding means that, when it is decided that the application information is not received by the application deadline, and when the access time comes earlier than the first time, decides whether or not the access information is received by the access information receiving means a plurality of times, wherein when the second deciding means decides that the access information is received a plurality of times, the setting means makes the first send time come later than the second send time.

When the user accesses a webpage a plurality of times, it is considered that the user put off determination as to whether or not to apply to purchase a product every time the user checks information listed in the webpage, and finally does not end up in applying for purchase. In this case, the present invention can make a relative send time of an electronic mail come late, so that the user is more likely to access a webpage relatively late. Consequently, the user thinks about applying to purchase a product with a smaller number of times of access, so that it is possible to make the user feel impatient about applying to purchase the product. Consequently, it is possible to encourage the user to apply to purchase the product.

The invention according to claim 8 is the electronic mail sending device according to any one of claims 1 to 7, further comprising:

a third deciding means that decides whether or not the access information is received by the access information receiving means;

an acquiring means that acquires a mail opening time of the electronic mail; and a third comparing means that compares the mail opening time acquired by the acquiring means and a second time set in advance, wherein, when the third deciding means decides that the access information is not received, and when the mail opening time comes later than the second time as a result of the comparison by the third comparing means, the setting means makes the first send time come earlier than the second send time.

When an electronic mail which notifies the application deadline to purchase a product is opened late and an access is not made to a webpage which lists information about this product, and, when purchase of this product is not applied for, it is assumed that a time to the application deadline to purchase the product is short, and therefore the user does not have much time to browse the webpage. In this case, the present invention can make a relative send time of an electronic mail come early, so that the time when the user opens the electronic mail comes relatively early. Consequently, it is possible to give the user the time to browse the webpage. Consequently, it is possible to encourage the user to apply to purchase the product.

The invention according to claim 9 is the electronic mail sending device according to claim 8, wherein, when it is decided that the access information is not received, and when the mail opening time comes later than the second time, the setting means makes the first send time come earlier than the second send time for a period of time corresponding to or more than the difference between the mail opening time and the second time.

The present invention can more reliably give a time to browse the webpage.

The invention according to claim 10 is the electronic mail sending device according to claim 8 or claim 9, wherein:

the setting means that comprises a fourth comparing means that, when it is decided that the access information is not received, and when the mail opening time comes earlier than the second time, compares the mail opening time and time which comes a preset second period of time before the second time; and when the mail opening time comes earlier than the time which comes the second period of time before the second time as a result of the comparison by the fourth comparing means, the setting means makes the first send time come later than the second send time.

When an electronic mail which notifies the application deadline to purchase a product is opened early and an access is not made to a webpage which lists information about this product, and, when purchase of this product is not applied for, it is considered that a time to the application deadline to purchase the product is too long, and therefore the user does not feel impatient about browsing the webpage. In this case, the present invention can make a relative send time of an electronic mail come late, so that the user is more likely to open this electronic mail relatively late. Consequently, it is possible to make the user feel impatient about browsing the webpage while giving the user the time to browse the webpage. Consequently, it is possible to encourage the user to apply to purchase the product.

The invention according to claim 11 is the electronic mail sending device according to claim 10, wherein, when the mail opening time comes earlier than the time which comes the second period of time before the second time, the setting means makes the first send time come later than the second send time for a period of time corresponding to or more than the difference between the mail opening time and the time which comes the second period of time before the second time.

The present invention can more reliably make the user feel impatient about browsing the webpage.

The invention according to claim 12 is the electronic mail sending device according to any one of claims 8 to 11, further comprising:

a third calculating means that calculates a time from the access to the webpage to the application to purchase the product, based on a history of a user of an address of the electronic mail sent by the sending means, among histories stored in a memory means that stores a history of an access to a webpage which lists information about the product to be traded and a history of an application to purchase a product; and a third time setting means that sets, as the second time, time which comes the time calculated by the third calculating means or more before the application deadline notified by the electronic mail sent by the sending means, wherein:

the third comparing means compares the mail opening time and the second time set by the third time setting means; and the setting means sets the first send time of the electronic mail in which an address of a user matches with the electronic mail sent by the sending means.

The present invention sets as a second time a time which comes the time required from an access to the webpage to an application for purchase before the application deadline. Consequently, it is possible to accurately decide whether or not the user has a time to browse the webpage.

The invention according to claim 13 is the electronic mail sending device according to any one of claims 8 to 12, further comprising:

a fourth calculating means that calculates a time from the access to the webpage to the application to purchase the product, based on a history of a product whose type matches with the product whose application deadline is notified by the electronic mail sent by the sending means, among histories stored in a memory means that stores a history of an access to a webpage which lists information about the product to be traded and a history of an application to purchase a product; and a fourth time setting means that sets, as the second time, the time which comes the time calculated by the fourth calculating means or more before the application deadline notified by the electronic mail sent by the sending means, wherein:

the third comparing means compares the mail opening time and the second time set by the fourth time setting means; and the setting means sets the first send time of the electronic mail in which a type of a product whose application deadline is notified matches with the electronic mail sent by the sending means.

The present invention sets as a second time a time which comes the time required from an access to the webpage to an application for purchase before the application deadline. Consequently, it is possible to accurately decide whether or not the user has a time to browse the webpage The invention according to claim 14 is a send time setting method in an electronic mail sending device that sends an electronic mail which notifies an application deadline in transaction for which the application deadline to purchase a product is set, the send time setting method comprising:

a sending step of sending the electronic mail which includes link information to a webpage which lists information about the product to be traded;

an access information receiving step of receiving access information which indicates an access to the webpage indicated by the link information included in the electronic mail, from a terminal device;

an application information receiving step of receiving application information which indicates an application to purchase the product whose information is listed in the webpage, from the terminal device;

a first deciding step of deciding whether or not the application information is received in the application information receiving step by the application deadline;

a first comparing step of comparing an access time to the webpage indicated by a reception time of the access information in the access information receiving step, and a first time set in advance; and a setting step of, when it is decided in the first deciding step that the application information is not received by the application deadline, and when the access time comes later than the first time as a result of the comparison in the first comparing step, setting a first send time which is a send time of the electronic mail to be sent next in the sending step and which is relative to the application deadline notified by the electronic mail, come earlier than a second send time which is a send time of the electronic mail sent in the sending step and which is relative to the application deadline notified by the electronic mail.

One aspect of an exemplary embodiment includes a send time setting program causing a computer included in an electronic mail sending device that sends an electronic mail which notifies an application deadline in transaction for which the application deadline to purchase a product is set, to function as:

a sending means that sends the electronic mail which includes link information to a webpage which lists information about the product to be traded;

an access information receiving means that receives access information which indicates an access to the webpage indicated by the link information included in the electronic mail, from a terminal device;

an application information receiving means that receives application information which indicates an application to purchase the product whose information is listed in the webpage, from the terminal device;

a first deciding means that decides whether or not the application information receiving means receives the application information by the application deadline;

a first comparing means that compares an access time to the webpage indicated by a reception time of the access information by the access information receiving means, and a first time set in advance; and a setting means that, when the first deciding means decides that the application information is not received by the application deadline, and when the access time comes later than the first time as a result of the comparison by the first comparing means, makes a first send time which is a send time of the electronic mail to be sent next by the sending means and which is relative to the application deadline notified by the electronic mail, come earlier than a second send time which is a send time of the electronic mail sent by the sending means and which is relative to the application deadline notified by the electronic mail.

One aspect of an exemplary embodiment includes a recording medium having a computer-readable send time setting program recorded thereon that causes a computer included in an electronic mail sending device that sends an electronic mail which notifies an application deadline in transaction for which the application deadline to purchase a product is set, to function as:

a sending means that sends the electronic mail which includes link information to a webpage which lists information about the product to be traded;

an access information receiving means that receives access information which indicates an access to the webpage indicated by the link information included in the electronic mail, from a terminal device;

an application information receiving means that receives application information which indicates an application to purchase the product whose information is listed in the webpage, from the terminal device;

a first deciding means that decides whether or not the application information receiving means receives the application information by the application deadline;

a first comparing means that compares an access time to the webpage indicated by a reception time of the access information by the access information receiving means, and a first time set in advance; and a setting means that, when the first deciding means decides that the application information is not received by the application deadline, and when the access time comes later than the first time as a result of the comparison by the first comparing means, makes a first send time which is a send time of the electronic mail to be sent next by the sending means and which is relative to the application deadline notified by the electronic mail, come earlier than a second send time which is a send time of the electronic mail sent by the sending means and which is relative to the application deadline notified by the electronic mail.

Advantageous Effects of Invention

According to the present invention, when an access to a webpage which lists information about a product is late and purchase of this product is not applied for, it is possible to make a relative send time of an electronic mail come early and, consequently, the user is more likely to access the webpage relatively early. Consequently, it is possible to give the user the time to think about whether or not to apply to purchase a product. Therefore, it is possible to encourage the user to apply to purchase the product.

BRIEF DESCRIPTION OF DRAWINGS

FIG. 3A is a view illustrating an example of content registered in a member information DB 12*a*. FIG. 3B is a view illustrating an example of content registered in an auction information DB 12*b*. FIG. 3C is a view illustrating an example of content registered in a watch list DB 12*c*. FIG. 3D is a view illustrating an example of content set to registered auction information. FIG. 3E is a view illustrating an example of content set to date and time record information. FIG. 3F is a view illustrating an example of content registered in a history DB 12*d*. FIG. 3G is a view illustrating an example of content set to an access history. FIG. 3H is a view illustrating an example of content set to a bidding history.

FIG. 10A is a view illustrating an example of content registered in a received mail DB 22*a*. FIG. 10B is a view illustrating an example of content set to date and time record information.

MODE FOR CARRYING OUT THE INVENTION

Embodiments of the present invention will be described below in detail with reference to the drawings. In addition, the embodiments will be described below where the present invention is applied to an auction system.

1. First Embodiment

1-1. Outline of Configuration and Function of Auction System

First, an outline of a configuration and a function of an auction system S1 according to a first embodiment will be described using FIG. 1.

Figure 1:
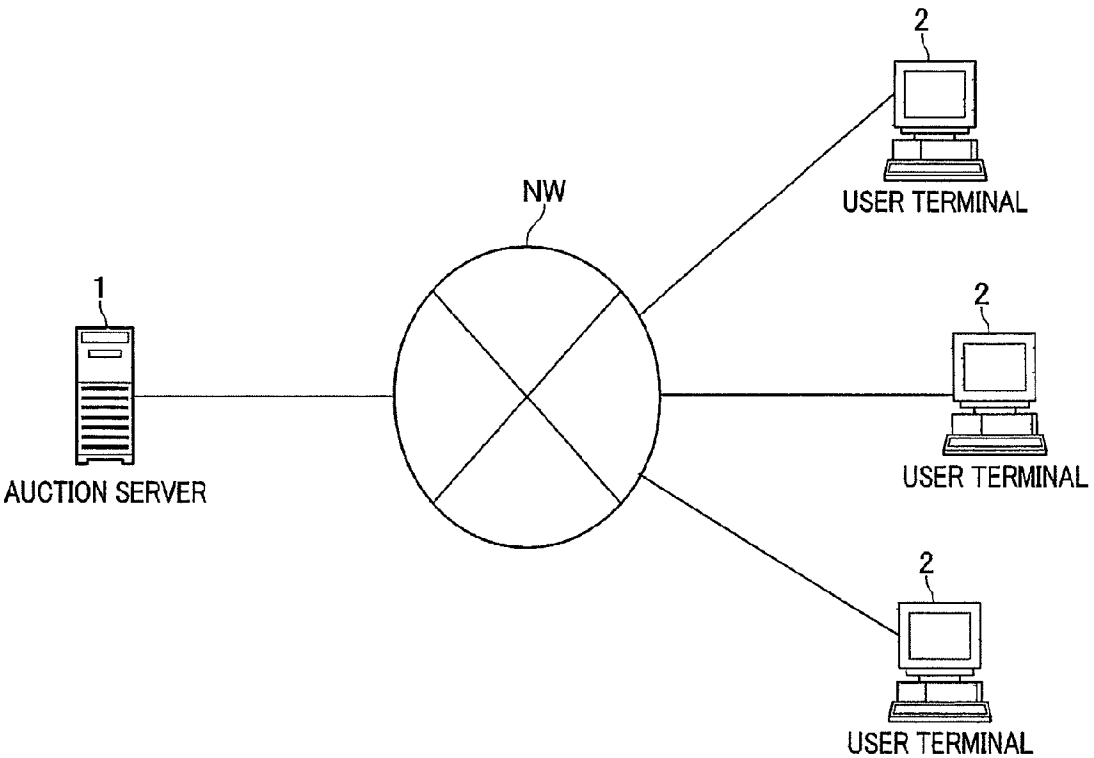
FIG. 1 is a view illustrating an example of a schematic configuration of an auction system S1 according to an embodiment.

FIG. 1 is a view illustrating an example of a schematic configuration of the auction system S1 according to the present embodiment.

As illustrated in FIG. 1, the auction system S1 has an auction server 1 (an example of an electronic mail sending device in the present invention), and a plurality of user terminals 2. Further, the auction server 1 and each user terminal 2 can transmit and receive data to and from each other using, for example, TCP/IP for a communication protocol through a network NW. In addition, the network NW is constructed with, for example, the Internet, a dedicated communication line (for example, CATV (Community Antenna Television) line), a mobile communication network (including, for example, base stations) and a gateway.

The auction server 1 is a server device which configures an auction site at which an auction is held among users using the user terminals 2. The auction server 1 executes processing related to search for an auction (listed product), sending of an auction page (a webpage which lists detailed information about a product listed in the auction), bidding and closing the bidding according to requests from the user terminals 2. In addition, bidding of a product is, for example, user's application to purchase the product.

The user terminal 2 is a terminal device which is used by a user registered as a member in the auction site. The user operates the user terminal 2 to access the auction site and, for example, search for an auction or list a product or make a bid. Type of software such as a browser and an electronic mail client are installed in the user terminal 2. For the user terminals 2, a personal computer, a mobile information terminal such as a PDA (Personal Digital Assistant) or a smartphone, and a mobile telephone are used.

In the auction system S1 employing this configuration, the user can register an auction which is being held in a watch list. The auction registered in the watch list is displayed as a list in a watch list page (a webpage for the watch list). The user can occasionally check, for example, a current price or a bidding situation of a registered auction by browsing the watch list page.

When an auction is registered in the watch list, the auction server 1 sends a remind mail of the registered auction (an example of an electronic mail in the present invention) to a registered user. The remind mail is an electronic mail which notifies that the auction is about to end before the auction ends, and is an electronic mail which notifies an end date and time of the auction. In a body of the remind mail, for example, a product name of an auction, an auction ID which is identification information of the auction, a current price, the number of biddings, an auction end scheduled date and time and a URL (Uniform Resource Locator) of a corresponding auction page are described.

A send date and time of the remind mail is set by the auction server 1. More specifically, the send date and time of the remind mail is set based on the auction end date and time and a relative send time of the remind mail. The relative send time of the remind mail is a send date and time of the remind mail which is relative to the auction end date and time. That is, the relative send time of the remind mail is time information indicating to what extent before the auction ends the remind mail is sent. For example, the auction end time is 8 o'clock, and the relative send time of the remind mail is 30 minutes before the auction end time. In this case, the send time of the remind mail is 7:30.

The auction server 1 optimizes a relative send time of this remind mail per user. A purpose of this optimization is to encourage the user to make a bid by sending a remind mail at an effective timing. More specifically, the auction server 1 determines a relative send time based on an end date and time of a closed auction, a send date and time of the remind mail of this auction, a mail opening date and time, an access date and time to an auction page of this auction and whether or not a bid is made among auctions registered in the watch list by the user.

1-2. Configuration of Auction Server

Next, the configuration of the auction server 1 will be described using FIGS. 2 and 3.

Figure 2:
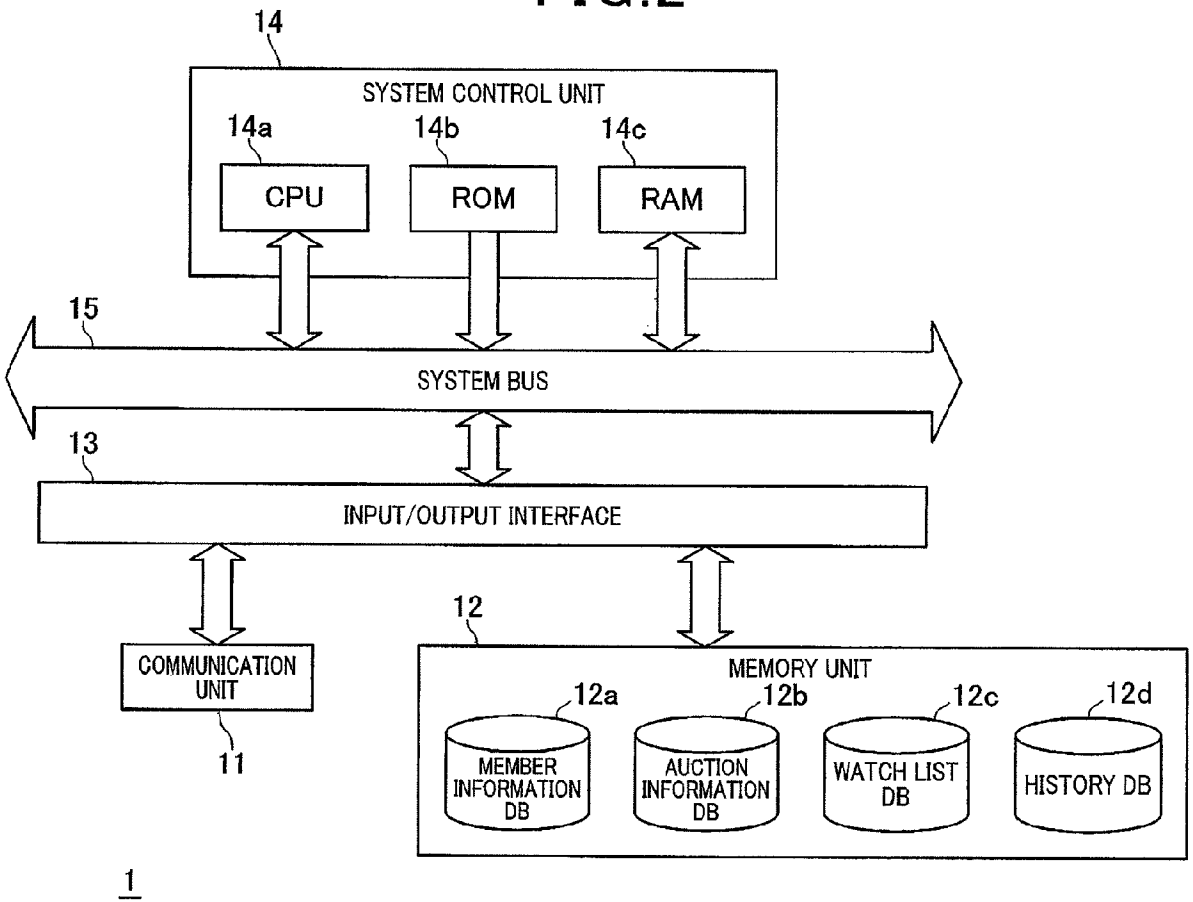
FIG. 2 is a block diagram illustrating an example of a schematic configuration of an auction server 1 according to the embodiment.

FIG. 2 is a block diagram illustrating an example of a schematic configuration of the auction server 1 according to the present embodiment. Further, FIG. 3A is a view illustrating an example of content registered in a member information DB 12*a*. Furthermore, FIG. 3B is a view illustrating an example of content registered in an auction information DB 12*b*. Still further, FIG. 3C is a view illustrating an example of content registered in a watch list DB 12*c*. Moreover, FIG. 3D is a view illustrating an example of content set to registered auction information. Further, FIG. 3E is a view illustrating an example of content set to date and time record information. FIG. 3F is a view illustrating an example of content registered in a history DB 12*d*. Further, FIG. 3G is a view illustrating an example of content set to an access history. Furthermore, FIG. 3H is a view illustrating an example of content set to a bidding history.

As illustrated in FIG. 2, the auction server 1 has a communication unit 11, a memory unit 12, an input/output unit 13 and a system control unit 14. Further, the system control unit 14 and the input/output interface 13 are connected through a system bus 15.

The communication unit 11 connects to the network NW to control communication states with, for example, the user terminals 2.

The memory unit 12 is configured by, for example, a hard disk drive. In this memory unit 12, the member information DB 12*a*, the auction information DB 12*b* and the watch list DB 12*c* are constructed.

In the member information DB 12*a*, member information related to users registered as members in the auction site is registered. More specifically, as illustrated in FIG. 3A, in the member information DB 12*a*, a user ID, a password, a name, a date of birth, the sex, an address, a telephone number and an electronic mail address which are identification information of a user are associated and registered per user.

In the auction information DB 12*c*, auction information related to an auction which is being held is registered. More specifically, as illustrated in FIG. 3B, in the auction information DB 12*b*, an auction ID, a seller user ID which is a user ID of a user who lists a product, a product name of a listed product, a description, a start price, a start date and an end date of an auction (an example of an application deadline in the present invention) and a watch list registered user ID list are associated and registered per auction.

The end date and time is a scheduled date and time when an auction ends. The watch list registered user ID list is a list of user IDs of users who register auctions in the watch list.

In the watch list DB 12*c*, a watch list and information related to a remind mail are registered. More specifically, as illustrated in FIG. 3C, in the watch list DB 12*c*, a user ID, registered auction information, a relative send time of a remind mail and date and time record information are associated and registered per user.

In the registered auction information, information related to auctions registered in the watch list is registered. More specifically, as illustrated in FIG. 3D, in the registered auction information, an auction ID, a sending scheduled date and time of a remind mail, an end scheduled date and time of an auction, and a remind mail send flag are associated and registered per registered auction. The remind mail send flag is flag information indicating whether or not a remind mail has been sent. When the remind mail is not yet sent, the remind mail send flag is set to "unsent", and, when the remind mail is sent, the remind mail send flag is set to "sent".

In the date and time record information, for example, a date and time of a user's behavior related to an auction registered in the watch list and a date and time of processing of the auction server 1 are set. More specifically, as illustrated in FIG. 3E, in the date and time record information, an auction ID, a message ID, a send date and time of a remind mail, and a mail opening date and time of the remind mail (an example of a mail opening date and time in the present invention) are associated and set per auction. The message ID is a message ID described in a header of a sent remind mail. The send date and time is a date and time when the remind mail is sent. The mail opening date and time is a date and time when the user opens the remind mail. Opening the electronic mail is a user's operation of displaying a body of the electronic mail on a screen of the user terminal 2.

In the history DB 12*d*, a history of user's behaviors at an auction site is registered. More specifically, as illustrated in FIG. 3F, in the history DB 12*d*, for example, an access history and a bidding history are registered.

The access history is information indicating a history of accesses to auction pages. More specifically, as illustrated in FIG. 3G, in the access history, an auction ID of an auction associated with an accessed auction page, an access date and time to the auction page (an example of the access time in the present invention), a URL of the accessed auction page (an example of link information in the present invention) and a user ID of an accessing user are associated and set per access to the auction page. The access date and time to the auction page is a date and time when the auction server 1 receives a request for an auction page from the user terminal 2. The request for the auction page is message information indicating an access to the auction page. A message ID of a remind mail is added to the URL of the auction page in some cases because the URL of the auction page to which the message ID is added is described in the body of the remind mail. That is, when the user accesses the auction page by selecting the URL described in the received remind mail, the URL to which the message ID is added is recorded in the access history.

The bidding history is information indicating a history of bidding on an auction. More specifically, as illustrated in FIG. 3G, in the bidding history, an auction ID of an auction which is bid, a bidding date and time, a user ID of a user who makes a bid and a bid are associated and set per bidding.

In the memory unit 12, for example, an initial value of a relative send time of a remind mail and various reference values used to optimize the relative send time are further stored. These initial value and reference values are set in advance by an administrator of the auction site.

Further, in the memory unit 12, various items of data such as HTML (Hyper Text Markup Language) document, XML (Extensible Markup Language) document, image data, text data and electronic document which configure webpages of the auction site are stored.

Furthermore, in the memory unit 12, an operating system, a WWW (World Wide Web) server program and a SMTP (Simple Mail Transfer Protocol) server program are stored. Still further, in the memory unit 12, an auction managing program (including an example of a send time setting program in the present invention) which the auction server 1 uses to execute various types of processing related to the auction is stored. In addition, for example, the auction managing program may be acquired from, for example, another server device through the network NW, or may be recorded in a recoding medium such as a DVD (Digital Versatile Disc) and read through a drive device.

The input/output interface 13 performs interface processing between the communication unit 11 and the memory unit 12, and the system control unit 14.

The system control unit 14 has, for example, a CPU (Central Processing Unit) 14*a*, a ROM (Read Only Memory) 14*b* and a RAM (Random Access Memory) 14*c*. Further, when the CPU 14*a* reads and executes the auction managing program, the system control unit 14 functions as a sending means, an access information receiving means, an application information receiving means, a first deciding means, a first comparing means, a setting means, a second comparing means, a second deciding means, a third deciding means, an acquiring means, a third comparing means, a fourth comparing means, a first calculating means, a first time setting means, a third calculating means and a fourth time setting means according to the present invention.

In addition, the auction server 1 may be configured by a plurality of server devices. For example, a server device which sets a send date of a remind mail and sends the remind mail, a server device which sends a webpage of an auction site according to a request from the user terminal 2 and performs various types of processing related to an auction and a server device which manages various items of databases may be connected to each other through, for example, a LAN (Local Area Network).

1-3. Operation of Auction System

Next, an operation of the auction system S1 will be described using FIGS. 4 to 7.

Figure 4:
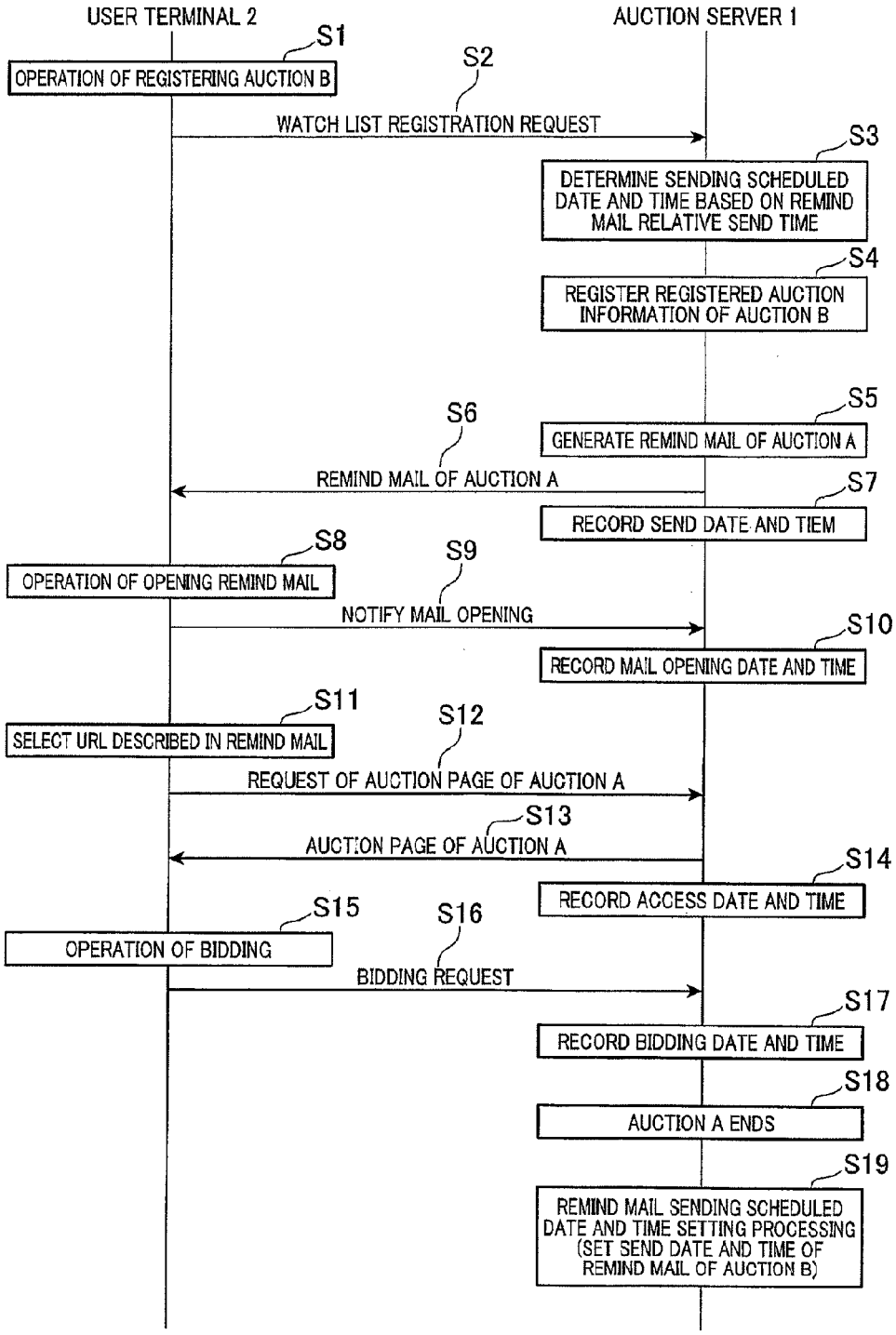
FIG. 4 is a sequence diagram illustrating a processing example from registration of a watch list to setting of a send date and time of a remind mail based on an end of an auction in the auction system S1 according to the embodiment.

FIG. 4 is a sequence diagram illustrating a processing example from registration of a watch list to setting of a send date and time of a remind mail based on an end of an auction in the auction system S1 according to the present embodiment.

For example, it is assumed that a user X has already registered an auction A in a watch list. Subsequently, as illustrated in FIG. 4, the user X performs an operation of browsing an auction page of an auction B, and registering the auction B in the watch list (step S1). Then, the user terminal 2 sends a watch list registration request of the auction B to the auction server 1 (step S2).

When receiving the watch list registration request, the system control unit 14 of the auction server 1 determines a sending scheduled date and time set to registered auction information of the auction B (step S3). More specifically, the system control unit 14 acquires the auction information of the auction B from the auction information DB 12*b*. Next, the system control unit 14 acquires a relative send time of a remind mail of the user X from the watch list DB 12*c*. Further, the system control unit 14 calculates the sending scheduled date and time by subtracting the relative send time of the remind mail from the end time of the auction set to the auction information.

When determining the sending scheduled date and time, the system control unit 14 registers the registered auction information of the auction B in the watch list DB 12*c* (step S4). More specifically, the system control unit 14 associates an auction ID of the auction B, the determined sending scheduled date and time, the end date and time of the auction set to the auction information of the auction B and registered auction information including a remind mail send flag set to "unsent" with the user ID of the user X to register. Further, the system control unit 14 adds and registers the user ID of the user X to the watch list registered user ID of the auction information of the auction B.

Subsequently, the system control unit 14 decides that the sending scheduled date and time of the remind mail of the auction A arrived, based on the registered auction information associated with the auction A of the user X. Then, the system control unit 14 generates the remind mail of the auction A (step S5). More specifically, the system control unit 14 acquires template data which is a source of a remind mail from the memory unit 12, and generates the remind mail by making various settings to the template data. Meanwhile, the system control unit 14 generates a unique message ID, and sets the message ID to a header of a remind mail. Further, the system control unit 14 sets a mail opening notice. As the electronic mail address of a notice destination in this case, the system control unit 14 sets an electronic mail address dedicated to a mail opening notice. Further, the system control unit 14 acquires the electronic mail address of the user X from the member information DB 12*a*, and sets this electronic mail address to the address. Furthermore, the system control unit 14 generates a message in a body based on the auction information of the auction A. Still further, the system control unit 14 sets a URL of the auction page of the auction A to the main body of the remind mail. The URL of the auction page includes an auction ID of a corresponding auction. The system control unit 14 adds the generated message ID to the URL of the auction page, and sets the URL to the body of the remind mail.

The system control unit 14 as the sending means sends the remind mail generated in this way (step S6). Next, the system control unit 14 records a send date and time of the remind mail (step S7). More specifically, the system control unit 14 acquires a current date and time as the send date and time of the remind mail. Further, the system control unit 14 registers the message ID and the send date and time of the remind mail of the date and time record information of the user X registered in the watch list DB 12*c* as the date and time record information associated with the auction A. In addition, the sending scheduled date and time set to the registered auction information may be the send date and time to be registered in the date and time record information. Further, the system control unit 14 sets to "sent" a remind mail send flag in the registered auction information associated with the auction A of the user X.

The sent remind mail is relayed through a plurality of mail servers where necessary, and then is stored in a mail server indicated by a domain name portion of the electronic mail address which is the address. Subsequently, according to the operation of the user X, the user terminal 2 receives the remind mail from the mail server. Further, when the user X performs a mail opening operation, the user terminal 2 displays the body of the remind mail on the screen (step S8). Then, the user terminal 2 sends a mail opening notice mail (an electronic mail which notifies mail opening) by means of a mail opening notifying function of an electronic mail client (step S9). The mail opening notice mail arrives at the auction server 1 through the mail server.

The system control unit 14 decides that the electronic mail address which is an address of the received electronic mail is an electronic mail address dedicated to a mail opening notice, and the received electronic mail is the mail opening notice mail. In this case, the system control unit 14 records a mail opening date and time of the remind mail (step S10). More specifically, the system control unit 14 acquires a message ID from an In-Reply-To field of the mail opening notice mail. In the In-Reply-To field, the message ID of the remind mail which is a source of a reply of the mail opening notice mail is set. Further, the system control unit 14 acquires a send date and time of the mail opening notice mail, from the mail opening notice mail. Next, the system control unit 14 searches for the date and time record information to which the acquired message ID is set, from the watch list DB 12*c*. Further, the system control unit 14 registers the send date and time of the acquired mail opening notice mail in the searched date and time record information as the mail opening date and time of the remind mail.

A method of recording the mail opening date and time of the remind mail may use, for example, a HTML mail (an electronic mail described according to HTML) instead of using the mail opening notifying function of the electronic mail client. More specifically, the system control unit 14 inserts in the HTML mail a script which allows the user terminal 2 to send the mail opening notice request (a HTTP request indicating a mail opening notice) to the auction server 1 when the body of the HTML mail is displayed. In this case, the system control unit 14 describes the script in the URL set to a request row of the mail opening notice request such that a message ID of the remind mail is added. By this means, the system control unit 14 can search for corresponding date and time record information from the received mail opening notice request. In addition, whether the mail opening notifying function of the electronic mail client is used or a HTML mail is used may be set in advance based on user's selection.

Subsequently, the user X who opens the remind mail performs an operation of selecting the URL of the auction page described in the body of the remind mail (step S11). Then, the user terminal 2 sends a request (an example of access information in the present invention) of the auction page including the selected URL to the auction server 1 (step S12).

The system control unit 14 sends the auction page of the auction A to the user terminal 2 according to the URL included in the request of the auction page received by the access information receiving means (step S13). Next, the system control unit 14 records the access date and time of the auction page (step S14). More specifically, the system control unit 14 acquires the auction ID from the URL included in the request of the auction page. Next, the system control unit 14 acquires the current date and time as the access date and time. Next, the system control unit 14 registers the acquired auction ID, access date and time, URL included in the request and the access history including the user ID of the user X, in the history DB 12*d*.

Subsequently, the user who browses the auction page of the auction A performs a bidding operation (step S15). Then, the user terminal 2 sends a bidding request to the auction server 1 (step S16). The bidding request is message information indicating that a bid is made.

The system control unit 14 performs bidding processing based on the bidding request received by the application information receiving means, and records the bidding date and time (step S17). More specifically, the system control unit 14 acquires the current date and time as the bidding date and time. Next, the system control unit 14 registers the auction ID of the auction A, the acquired bidding date and time, the user ID of the user X and the bidding history including the bid, in the history DB 12*d*.

Subsequently, when the auction A ends (step S18), the system control unit 14 executes remind mail sending scheduled date and time setting processing (step S19). The system control unit 14 may execute the remind mail sending scheduled date and time setting processing, for example, immediately after the auction ends. Further, the system control unit 14 may execute the remind mail sending scheduled date and time setting processing on a regular basis (for example, once an hour). In this case, the system control unit 14 searches for auction information about the closed auction after previous remind mail sending scheduled date and time setting processing is executed, from the auction information DB 12*b*, and executes the remind mail sending scheduled date and time setting processing with respect to each searched auction.

In this remind mail sending scheduled date and time setting processing, the system control unit 14 sets again the sending scheduled date and time of the remind mail of the auction B based on the send date and time of the remind mail to the user X of the auction A, the mail opening date and time of this remind mail, the access date and time when the user X accesses the auction page of the auction A, whether or not the user X bids on the auction A and the end date and time of the auction A. In addition, in the remind mail sending scheduled date and time setting processing, when the user X does not actually bid the auction A, the sending scheduled date and time is set again.

Figure 5:
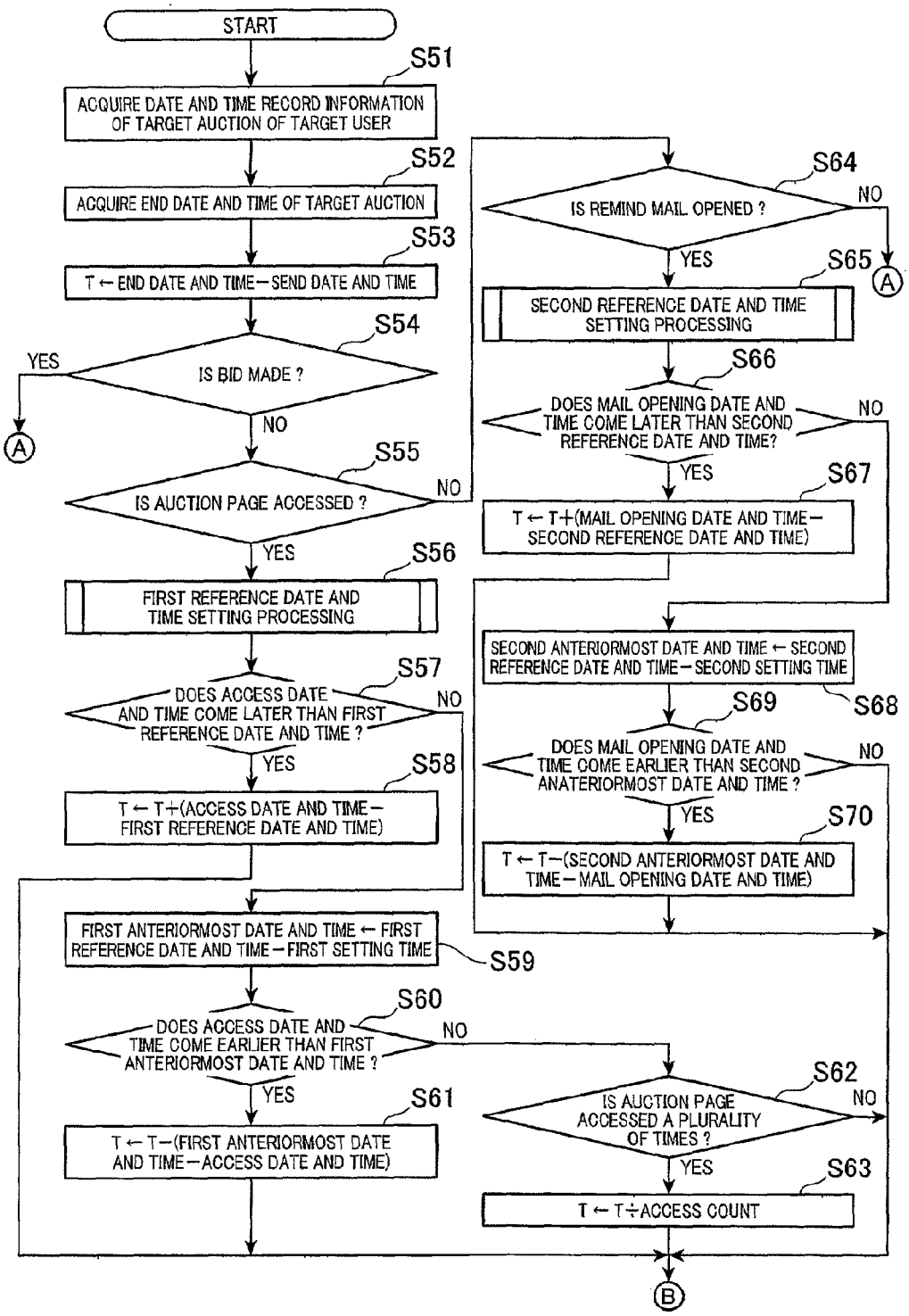
FIG. 5 is a flowchart illustrating a processing example in remind mail sending scheduled date and time setting processing of a system control unit 14 of the auction server 1 according to the embodiment.
Figure 6:
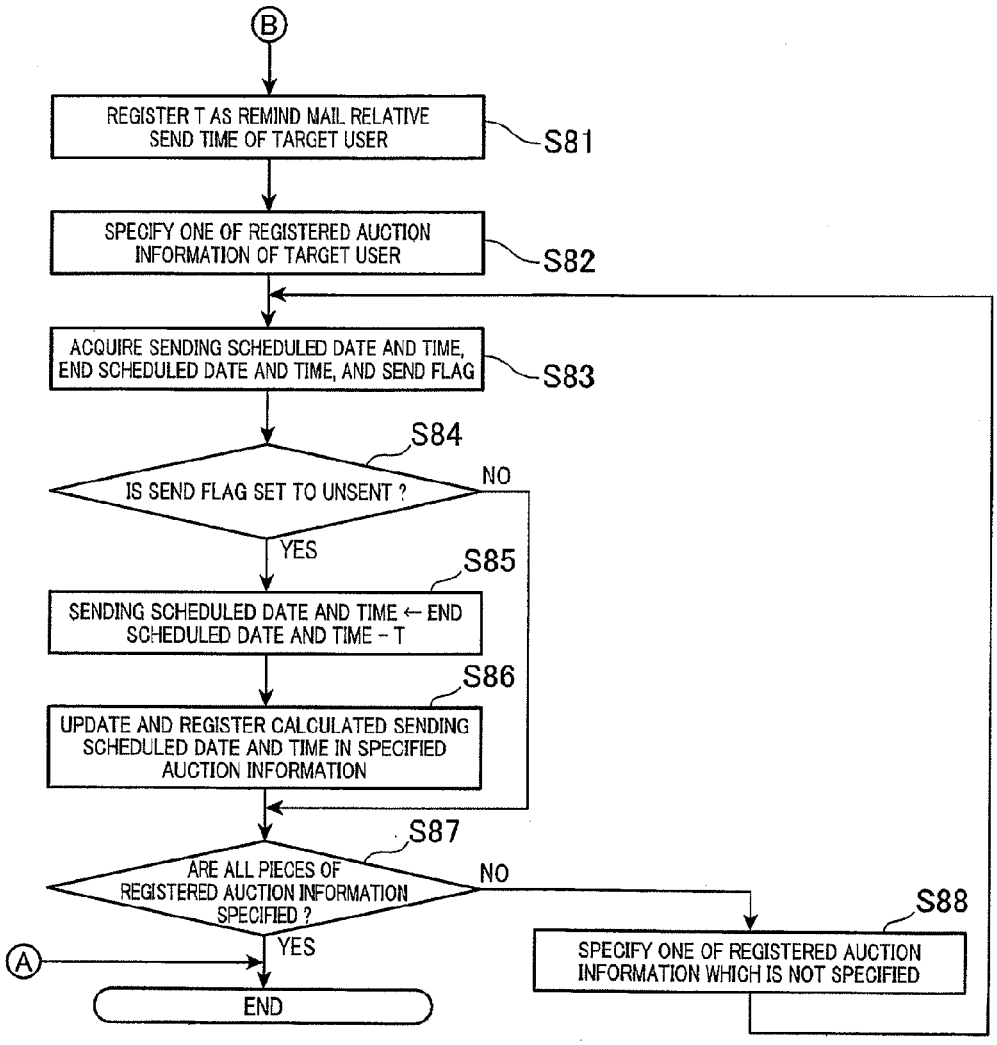
FIG. 6 is a flowchart illustrating a processing example in the remind mail sending scheduled date and time setting processing of the system control unit 14 of the auction server 1 according to the embodiment.

FIGS. 5 and 6 are flowcharts illustrating processing examples in remind mail sending scheduled date and time setting processing of the system control unit 14 of the auction server 1 according to the present embodiment.

The system control unit 14 specifies an auction ID of a closed auction (referred to as a "target auction"), and acquires auction information about the target auction from the auction information DB 12*b*. Next, the system control unit 14 acquires a watch list registered user ID list from the acquired auction information. The system control unit 14 executes remind mail sending scheduled date and time setting processing per user the user ID of which is registered in the watch list registered user ID list.

As illustrated in FIG. 5, the system control unit 14 as the acquiring means first acquires from the watch list DB 12*c* the date and time record information of the target auction of the date and time record information of a user (referred to as a "target user" below) associated with the user ID selected from the watch list registered user ID list (step S51).

Next, the system control unit 14 acquires the end date and time of the auction from the auction information of the target auction (step S52).

Next, the system control unit 14 subtracts the send date and time of the remind mail included in the acquired date and time record information from the acquired end date and time of the auction, and calculates a relative send time T (step S53). In addition, the relative send time T at this point of time is an example of a second send time in the present invention.

Next, the system control unit 14 as the first deciding means decides whether or not a target user bids on the target auction (step S54). That is, the system control unit 14 decides whether or not a bidding request is received from the user terminal 2 of the target user by the end date and time of the target auction. More specifically, the system control unit 14 searches for a bidding history including the auction ID of the target auction and the user ID of the target user, from the history DB 12*d*. In this case, the system control unit 14 decides that a bid is made when the bidding history can be searched for (YES in step S54). In this case, a purpose of encouraging bidding is fulfilled by the remind mail, and then the system control unit 14 ends the remind mail sending scheduled date and time setting processing.

Meanwhile, the system control unit 14 decides that a bid is not made when the bidding history cannot be searched for (NO in step S54). In this case, the system control unit 14 as the third deciding means decides whether or not the target user accesses the auction page after opening the remind mail (step S55). That is, the system control unit 14 decides whether or not the request of the auction page of the target auction is received from the user terminal 2 of the target user after the remind mail is opened. More specifically, the system control unit 14 searches for the access history including the auction ID of the target auction and the user ID of the target user, from the history DB 12*d*. In this case, the system control unit 14 excludes from search targets the access history the access date and time of which comes later than the end date and time of the target auction. In addition, the access history the access date and time of which comes later than the end date and time of the target auction may not be excluded from the search targets. Next, the system control unit 14 acquires the message ID from the acquired date and time record information. Next, the system control unit 14 decides whether or not there is one or more access histories to which a URL of the auction page to which the acquired message ID is added is set among the searched access histories. In this case, when there is not even one access history to which the URL of the auction page to which the message ID is added is set, the system control unit 14 decides that an auction page is not accessed after the remind mail is opened. Meanwhile, when there are one or more access histories to which the URL of the auction page to which the message ID is added is set, the system control unit 14 decides that the auction page is accessed after the remind mail is opened. In addition, the system control unit 14 makes decision by, for example, comparing the mail opening date and time set to the date and time record information and the access date and time set to the access history instead of making decision based on the URL. More specifically, the system control unit 14 may decide that the auction page is not accessed after the remind mail is opened when there is not even one access history of which access date and time comes later than the mail opening date and time, and decide that the auction page is accessed after the remind mail is opened when there is one or more access histories of which access dates and times come later than the mail opening date.

When deciding that the auction page is accessed after the remind mail is opened (YES in step S55), the system control unit 14 executes first reference date and time setting processing (step S56). In the first reference date and time setting processing, a first reference date and time to be compared with the access date and time to the auction page is set. The first reference date and time (an example of a first time in the present invention) is a time for deciding that, when the first reference date and time comes later than the access date and time, the user does not have time to think about bidding based on information listed in the accessed auction page.

Figure 7A:
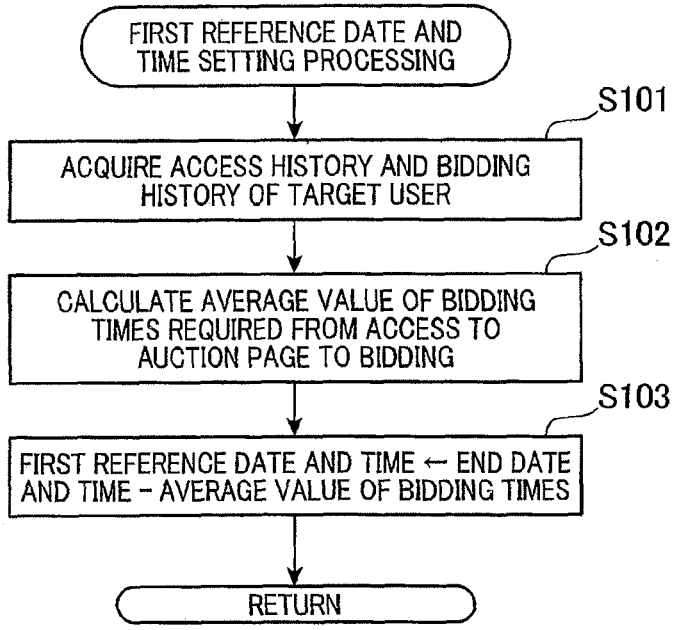
FIG. 7A is a flowchart illustrating a processing example in first reference date and time setting processing of the system control unit 14 of the auction server 1 according to the embodiment.

FIG. 7A is a flowchart illustrating a processing example in first reference date and time setting processing of the system control unit 14 of the auction server 1 according to the present embodiment.

As illustrated in FIG. 7A, the system control unit 14 searches for and acquires all access histories and bidding histories including the user ID of the target user, from the history DB 12*d* (step S101).

Next, the system control unit 14 as the first calculating means calculates an average value of bidding times (step S102). The bidding time is a time which the user requires from an access to the auction page to bidding. The system control unit 14 specifies the access history and the bidding history including the identical auction ID from the acquired access histories and bidding histories. Next, the system control unit 14 subtracts the access date and time set to the specified access history from the bidding date and time set to the specified bidding history, and calculates the bidding time of one auction. Meanwhile, when the user accesses a given auction page a plurality of times, a plurality of access histories is registered. That is, a plurality of access dates and times is registered. In this case, for example, the system control unit 14 may calculate the bidding time using the access date and time which is closest to the bidding date and time or exclude the bidding time from a calculation target of the bidding time. Further, the system control unit 14 may calculate the bidding time of only the auction the auction page of which is accessed after the remind mail is opened. Whether or not the auction page is accessed after the remind mail is opened may be decided in the same way as decision in step S55. When calculating the bidding time of each auction, the system control unit 14 calculates the average value of bidding times by calculating a total value of the calculated bidding times and dividing the average value by the number of the calculated bidding times.

Next, the system control unit 14 as the first time setting means subtracts the average value of the bidding times from the end date and time of the target auction, and sets this subtraction result as the first reference date and time (step S103). When finishing this processing, the system control unit 14 finishes the first reference date and time setting processing. According to a behavior which the user has taken so far, when the user accesses the auction page on the first reference date and time, and subsequently performs an input operation, the auction ends. The bidding time is assumed to include a time which the user requires to think about whether or not to make a bid based on information listed in the accessed auction page, and, as a result, perform a bidding operation by deciding that a bid is made. When the access date and time comes later than the first reference date and time, the user cannot make a bid. That is, the user does not have time to think about bidding.

In addition, the system control unit 14 may calculate for the bidding time the first reference date and time using a value other than the average value. For example, the system control unit 14 may calculate a median value of the bidding times. Further, the system control unit 14 may use a value larger than the average value or the median value of the bidding times. Even the identical user causes varying times required to think about bidding. Therefore, when the first reference date and time is determined using the average value or the median value, the user does not have time to think about bidding in some cases. Hence, the first reference date and time is determined to allow a time to some degree. For example, the system control unit 14 may use a bidding time corresponding to an N percentile among all calculated bidding times. N is a constant larger than 50. When, for example, 100 bidding times are calculated, the N-th shortest bidding time is used to calculate the first reference time. Further, for example, the system control unit 14 may multiply the average value or the median value of the bidding times with a coefficient, and subtract a result from the end date and time of the auction and calculate the first reference time. A value of the coefficient in this case is an actual number larger than 1.

Back to FIG. 5, when finishing the first reference date and time and time setting processing, the system control unit 14 as the first comparing means compares the access date and time and the first reference date and time. Further, the system control unit 14 decides whether or not the access date and time comes later than the first reference date and time as a result of comparison (step S57). In this case, the system control unit 14 acquires the access date and time as the access date and time to be compared with the first reference date and time, from the access history to which the URL to which the message ID is added is set. When there is a plurality of access histories to which URLs to which message IDs are added are set, the system control unit 14 acquires, for example, the earliest access date and time among the access dates and times set to these access histories. When deciding that the access date and time comes later than the first reference date and time (YES in step S57), the system control unit 14 as the setting means makes the relative send time T come early (step S58). More specifically, the system control unit 14 calculates the difference between the access date and time and the first reference date and time by subtracting the first reference date and time from the access date and time. Further, the system control unit 14 adds the difference between the access date and time and the first reference date and time to the relative send time T. When finishing this processing, the system control unit 14 proceeds to step S81. The access date and time comes later than the first reference date and time, and therefore, it is assumed that although the user accesses the auction page, the user does not have time to think about bidding and therefore does not make a bid. Hence, it is possible to make the send date of the remind mail come early, so that the date and time to access the auction page is more likely to come early. Consequently, it is possible to give the user the time to think about bidding. The difference between the access date and time and the first reference date and time is added to the relative send time T because the date and time to access the auction page needs to near the date and time which comes the bidding time before the end date and time of the auction. In addition, the system control unit 14 may make the time for making the relative send time T come early shorter or longer than the difference between the access date and time and the first reference date and time. If only the relative send time T comes early, it is possible to give the user the time to think about bidding accordingly. By making the time for making the relative send time T come early the difference between the access date and time and the first reference date and time or more, an access can be made to the auction page at a date and time when it is possible to reliably give the time to think about bidding.

Meanwhile, when deciding that the access date and time does not come later than the first reference date and time (NO in step S57), the system control unit 14 determines a first anteriormost date and time (step S59). The first anteriormost date and time is a date and time for deciding that, when the access date and time comes earlier than this first anteriormost date and time, the user has too much time about bidding from information listed in the accessed auction page and therefore the user does not feel impatient about bidding. More specifically, the system control unit 14 calculates the first anteriormost date and time by subtracting the first setting time from the first reference date and time. The first setting time (an example of a primary time in the present invention) is, for example, a time which is set in advance by an administrator of an auction site and is stored in the memory unit 12.

Next, the system control unit 14 as the second comparing means compares the access date and time and the first anteriormost date and time. Further, the system control unit 14 decides whether or not the access date and time comes earlier than the first anteriormost date and time (step S60). In this case, when deciding that the access date and time comes earlier than the first anteriormost date and time (YES in step S60), the system control unit 14 as the setting means makes the relative send time T come late (step S61). More specifically, the system control unit 14 calculates the difference between the first anteriormost date and time and the access date and time by subtracting the access date and time from the first anteriormost date and time. Further, the system control unit 14 subtracts the difference between the first anteriormost date and time and the access date and time from the relative send time T. When finishing this processing, the system control unit 14 proceeds to step S81. It is assumed that the access date and time comes earlier than the first anteriormost date and time, and the user has too much time to think about bidding, the user does not feel impatient about bidding and therefore does not make a bid. Hence, it is possible to make the send date and time of the remind mail come late, so that the date and time to access the auction page is more likely to come late. Consequently, it is possible to make the user feel impatient. The difference between the first anteriormost date and time and the access date and time is subtracted from the relative send time T because a date and time to access the auction page is neared to a date and time which comes a time corresponding to the sum of the bidding time and the first setting time before the end date and time of the auction. In addition, the system control unit 14 may make the time for making the relative send time T come late shorter or longer than the difference between the first anteriormost date and time and the access date and time. If only the relative send time T comes late, it is possible to make the user feel impatient accordingly. When the time for making the relative send time T comes late is the difference between the first anteriormost date and time and the access date and time or more, it is possible to make the user access the auction page at a date and time when it is possible to reliably make the user feel impatient about bidding.

In addition, in step S58, the time for making the relative send time T come early is the sum of the difference between the access date and time and the first reference date and time and the first setting time or less. This is because the date and time to access the auction page needs to be prevented from coming earlier than the date and time which comes the time corresponding to the sum of the bidding time and the first setting time before the end date and time of the auction. When an access is made to the auction page before this date and time, there is too much time to think about bidding. Further, in step S61, the time for making the relative send time T come late is the sum of the difference between the first anteriormost date and time and the access date and time, and the first setting time or less. This is because the date and time to access the auction page needs to be prevented from coming later than the date and time which comes the bidding time after the end date and time of the auction. When an access is made to the auction page after this date and time, there is too much time to think about bidding.

In step S60, when deciding that the access date and time does not come earlier than the first anteriormost date and time (NO in step S60), the system control unit 14 as the second deciding means decides whether or not an auction page is accessed a plurality of times after the target user opens the remind mail (step S62). That is, the system control unit 14 decides whether or not a request for an auction page of the target auction is received a plurality of times from the user terminal 2 of the target user after the remind mail is opened. More specifically, the system control unit 14 acquires the access date and time from an access history to which a URL to which a message ID is added is set among access histories searched for decision in step S55. The system control unit 14 sets this access date and time as an initial access date and time. When there is a plurality of access histories to which URLs to which message IDs are added are set, the system control unit 14 sets the earliest access date and time as the initial access date and time. Next, the system control unit 14 decides whether or not there is an access history to which an access date and time which comes later than the initial access date and time is set among the searched access histories. In this case, when there is not the access history to which the access date and time which comes later than the initial access date and time is set, the system control unit 14 decides that the auction page is not accessed a plurality of times after the remind mail is opened. Meanwhile, when there is an access history to which the access date and time which comes later than the initial access date and time is set, the system control unit 14 decides that an auction page is accessed a plurality of times after the remind mail is opened. In addition, the system control unit 14 may make decision by, for example, comparing the mail opening date and time set to the date and time record information and the access date and time set to the access history. More specifically, the system control unit 14 may decide that an access is not made a plurality of times when there is only one access history to which the access date and time which comes later than the mail opening date and time is set, and decide that an access is made a plurality of times when there is a plurality of access histories to which the access date and time which comes later than the mail opening date and time is set. When deciding that the auction page is not accessed a plurality of times after the remind mail is opened (NO in step S62), the system control unit 14 proceeds to step S81.

Meanwhile, when deciding that an access is made to the auction page a plurality of times after the remind mail is opened (YES in step S62), the system control unit 14 as the setting means makes the relative send time T come late (step S63). More specifically, the system control unit 14 calculates the number of access histories to which the access date and time which comes later than the initial access date and time is set. Next, the system control unit 14 calculates an access count to the auction page after the remind mail is opened, by adding 1 to the calculated number. Further, the system control unit 14 divides the relative send time T by the calculated access count, and sets the resulting value as a new relative send time T. When finishing this processing, the system control unit 14 proceeds to step S81. The relative send time T is divided by the access count because one access to the auction page is enough to think about bidding. In addition, the system control unit 14 may make the relative send time T come later according to a method other than this calculating method.

In step S55, when deciding that the auction page is not accessed after the remind mail is opened (NO in step S55), the system control unit 14 decides whether or not the target user opens the remind mail (step S64). More specifically, when the mail opening date and time is not set to the acquired date and time record information, the system control unit 14 decides that the remind mail is not opened (NO in step S64). In this case, a user's behavior result with respect to the sent remind mail is not obtained, and therefore the system control unit 14 finishes the remind mail sending scheduled date and time setting processing.

Meanwhile, when the mail opening date and time is set to the acquired date and time record information, the system control unit 14 decides that the remind mail is opened (YES in step S64). In this case, the system control unit 14 executes the second reference date and time setting processing (step S65). In the second reference date and time setting processing, a second reference date and time to be compared with the mail opening date and time of the remind mail is set. The second reference date and time (an example of a second time in the present invention) is a date and time for deciding that, when the second reference date and time comes later than the mail opening date and time, the user does not have time to browse the auction page.

Figure 7B:
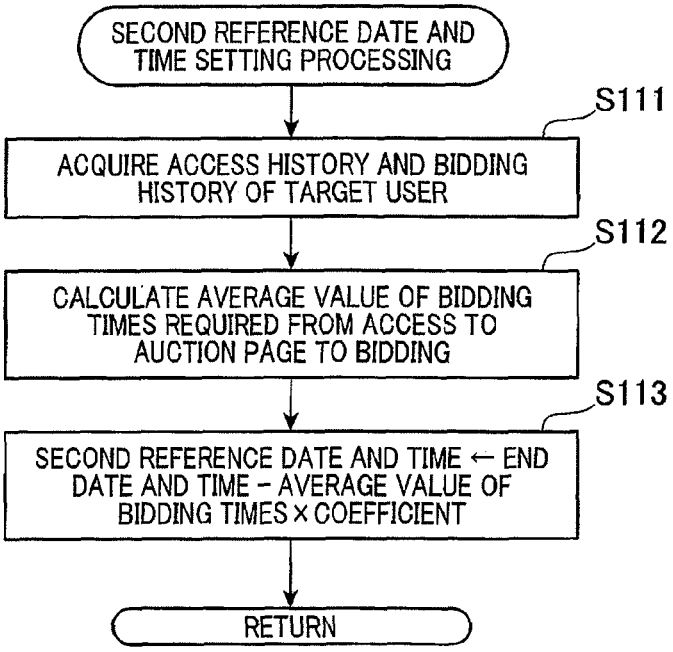
FIG. 7B is a flowchart illustrating a processing example in second reference date and time setting processing of the system control unit 14 of the auction server 1 according to the embodiment.

FIG. 7B is a flowchart illustrating a processing example in second reference date and time setting processing of the system control unit 14 of the auction server 1 according to the present embodiment.

As illustrated in FIG. 7B, the system control unit 14 as the third calculating means searches for access histories and bidding histories including the user ID of the target user, and calculates the average value of the bidding times (steps S111 and S112). This processing is the same as the processing in steps S101 and S102 in the first reference date and time setting processing.

Next, the system control unit 14 as the third time setting means sets the second reference date and time (step S113). More specifically, the system control unit 14 multiplies the median value of the bidding times with a coefficient. A value of the coefficient in this case is an actual number larger than 1. Further, the system control unit 14 calculates the second reference date and time by subtracting the multiplication result from the end date of the target auction. When finishing this processing, the system control unit 14 finishes the second reference date and time setting processing. The second reference date and time is a date which comes earlier than the first reference date and time. This is because, in addition to the bidding time, a time when the user opens the remind mail to a time when the user accesses the auction page is required. This time is defined based on the coefficient. In addition, instead of multiplying the bidding time with the count, the system control unit 14 may add the time set to the bidding time in advance as a time from opening of the remind mail to an access to an auction page. According to a behavior which the user has taken so far, when the user opens the remind mail on the second reference date and time, accesses the auction page by selecting the URL described in this remind mail and subsequently performs a bidding operation, the auction ends.

In addition, the system control unit 14 may calculate the second reference date and time by subtracting the average value of the bidding times and a predetermined value from the end date of the target auction. Further, similar to the first reference date and time setting processing, the system control unit 14 may calculate the second reference date and time using, for example, the median value of the bidding times or a percentile value.

Back to FIG. 5, when finishing the second reference date and time setting processing, the system control unit 14 as the third comparing means compares the mail opening date and time of the remind mail set to the date and time record information, and the second reference date and time. Further, the system control unit 14 decides whether or not the mail opening date and time comes later than the second reference date and time (step S66). In this case, when deciding that the mail opening date and time comes later than the second reference date and time (YES in step S66), the system control unit 14 as the setting means makes the relative send time T come early (step S67). More specifically, the system control unit 14 calculates the difference between the mail opening date and time and the second reference date and time by subtracting the second reference date and time from the mail opening date and time. Further, the system control unit 14 adds the difference between the mail opening date and time and the second reference date and time to the relative send time T. When finishing this processing, the system control unit 14 proceeds to step S81. It is assumed that the mail opening date and time comes later than the second reference date and time, and therefore the user does not have much time to browse the auction page and the user does not access the auction page. Hence, it is possible to make the send date and time of the remind mail come early, so that the mail opening date and time of the remind mail is more likely to come late. Consequently, it is possible to give the user the time to browse the auction page. The difference between the mail opening date and time and the second reference date and time is added to the relative send time T because the date to open the remind mail is neared to the date and time which comes a time corresponding to a multiple of a coefficient of the bidding time before the end date and time of the auction. In addition, the system control unit 14 may make the time for making the relative send time T come early shorter or longer than the difference between the mail opening date and time and the second reference date and time. If only the relative send time T comes early, it is possible to give the user the time to browse the auction page. When the time for making the relative send time T come early is the difference between the mail opening date and time and the second reference date and time or more, it is possible to make the user open the remind mail on a date and time when it is possible to reliably give the user the time to browse the auction page.

Meanwhile, when deciding that the mail opening date and time does not come later than the second reference date and time (NO in step S66), the system control unit 14 determines a second anteriormost date and time (step S68). The second anteriormost date and time is a date and time for deciding that, when the second anteriormost date and time comes earlier than the mail opening date and time, the user has too much time after opening the remind mail and does not feel impatient about browsing the auction page. More specifically, the system control unit 14 calculates the second anteriormost date and time by subtracting the second setting time from the second reference date and time. The second setting time (an example of a secondary time in the present invention) is, for example, a time which is set in advance by an administrator of an auction site and is stored in the memory unit 12.

Next, the system control unit 14 as the fourth comparing means compares the mail opening date and time and the second anteriormost date and time. Further, the system control unit 14 decides whether or not the mail opening date and time comes earlier than the second anteriormost date and time (step S69). In this case, when deciding that the mail opening date and time does not come earlier than the second anteriormost date and time (NO in step S69), the system control unit 14 proceeds to step S81.

In this case, when deciding that the mail opening date and time comes earlier than the second anteriormost date and time (YES in step S69), the system control unit 14 as the setting means makes the relative send time T come late (step S70). More specifically, the system control unit 14 calculates the difference between the second anteriormost date and time and the mail opening date and time by subtracting the mail opening date and time from the second anteriormost date and time. Further, the system control unit 14 subtracts the difference between the second anteriormost date and time and the mail opening date and time from the relative send time T. When finishing this processing, the system control unit 14 proceeds to step S81. It is assumed that the mail opening date and time comes earlier than the second anteriormost date and time, and the user has too much time after opening the remind mail and does not feel impatient about browsing the auction page and therefore does not access the auction page. Hence, it is possible to make the send date and time of the remind mail come late, so that the date and time to open the remind mail is more likely to come late. Consequently, it is possible to make the user feel impatient. The difference between the second anteriormost date and time and the mail opening date and time is added to the relative send time T because the date and time to open the remind mail is neared to the date and time which comes a time corresponding to the sum of a multiple of a coefficient of the bidding time and the second setting time before the end date and time of the auction. In addition, the system control unit 14 may make the time for making the relative send time T come late shorter or longer than the difference between the second anteriormost date and time and the mail opening date and time. If only the relative send time T comes late, it is possible to make the user feel impatient accordingly. When the date and time for making the relative send time T come late is the difference between the second anteriormost date and time and the mail opening date and time or more, it is possible to make the user open the remind mail on a date and time when it is possible to reliably make the user feel impatient about browsing the auction page.

In addition, in step S67, the time for making the relative send time T come late is the sum of the difference between the second anteriormost date and time and the mail opening date and time and the second setting time or less. This is because the date and time to open the remind mail needs to be prevented from coming later than a date and time which comes a time corresponding to the multiple of the coefficient of the bidding time before the end date and time of the auction. When the remind mail is opened before this date and time, there is too much time after the remind mail is opened. In addition, in step S70, the time for making the relative send time T come early is the sum of the difference between the mail opening date and time and the second reference date and time and the second setting time described below or less. This is because the date and time to open the remind mail needs to be prevented from coming earlier than the date and time which comes the time corresponding to the sum of the multiple of the bidding time and the second setting time before the end date and time of the auction. When the remind mail is opened before this date and time, there is not much time after the remind mail is opened.

In step S81 illustrated in FIG. 6, the system control unit 14 rewrites and registers the relative send time T at the current point of time as a relative send time of a new remind mail in the watch list DB 12 in association with the user ID of the target user. In addition, the relative send time T at this point of time is an example of a first send time in the present invention.

Next, the system control unit 14 specifies one of the registered auction information of the target user from the watch list DB 12*c* (step S82). Next, the system control unit 14 acquires a sending scheduled date and time of the remind mail, an end scheduled date and time of the auction and a remind mail send flag from the specified registered auction information (step S83).

Next, the system control unit 14 decides whether or not the acquired remind mail send flag is set to "unsent" (step S84). In this case, when deciding that the remind mail send flag is set to "unsent" (YES in step S84), the system control unit 14 calculates a new sending scheduled date and time of the remind mail by subtracting the relative send time T from the acquired auction end scheduled date and time (step S85). Next, the system control unit 14 as the setting means rewrites and registers the calculated sending scheduled date and time in the specified registered auction information (step S86).

When deciding that the remind mail send flag is set to "sent" (NO in step S84) or when finishing processing in step S86, the system control unit 14 decides whether or not all pieces of registered auction information of the target user are specified (step S87). In this case, when deciding that there is registered auction information which is not specified (NO in step S87), the system control unit 14 specifies one of registered auction information which is not specified (step S88), and proceeds to step S83.

Meanwhile, when deciding that all pieces of registered auction information of the target user are specified (YES in step S87), the system control unit 14 finishes remind mail sending scheduled date and time setting processing.

As described above, according to the present embodiment, the system control unit 14 of the auction server 1 sends a remind mail, receives a request of an auction page indicated by a URL included in the remind mail, from the user terminal 2, receives the bidding request from the user terminal 2, decides whether or not the bidding request is received by the end date and time of the auction, compares an access date and time to an auction page indicated by the reception date and time of the auction page request, and the first reference date and time, and, when deciding that the bidding request is not received by the end date and time of the auction and the access date and time comes later than the first reference date and time as a result of comparison, makes a relative send time of a remind mail to be sent next come earlier than a relative send time of a remind mail of the closed auction. Further, the system control unit 14 sets the send date and time of the remind mail based on the relative send time.

Consequently, it is possible to make the relative send time of the remind mail come early, so that the date and time when the user accesses the auction page comes relatively early. Consequently, it is possible to give the user the time to think about bidding. Consequently, it is possible to encourage the user to make a bid.

Further, the system control unit 14 makes the relative send time of the remind mail to be sent next come a time corresponding to the access date and time and the first reference date and time or more come earlier than the relative send time of the remind mail of the closed auction, so that it is possible to reliably give the time to think about whether or not to apply to purchase a product.

Furthermore, the system control unit 14 compares the access date and time and the first anteriormost date and time when deciding that the bidding request is not received by the end date and time of the auction and the access date and time comes earlier than the first reference date and time, and makes the relative send time of the remind mail to be sent next come later than the relative send time of the remind mail of the closed auction.

Consequently, it is possible to make the relative send time of the remind mail come late, so that the date and time when the user accesses the auction page is more likely to come relatively late. Consequently, it is possible to make the user feel impatient about bidding while giving to the user the time to think about bidding. Consequently, it is possible to encourage the user to make a bid.

Further, the system control unit 14 make the relative send time of the remind mail to be sent next come a time corresponding to a difference between the first anteriormost date and time and the access date and time or more later than the relative send time of the remind mail of the closed auction, so that it is possible to reliably make the user feel impatient about bidding.

Furthermore, the system control unit 14 calculates the bidding time based on the access histories and the bidding histories registered in the history DB 12*d*, and sets as the first reference date and time the date and time which comes the calculated bidding time or more before the end date and time of the auction.

Consequently, it is possible to accurately decide whether or not the user had time to think about bidding.

Further, the system control unit 14 decides whether or not a request of an auction page is received a plurality of times when deciding that the bidding request is not received by the end date and time of the auction and the access date and time comes earlier than the first reference date and time, and makes the relative send time of the remind mail to be sent next come later than the relative send time of the remind mail of the closed auction when deciding that the request is received a plurality of times.

Consequently, the relative send time of the remind mail comes late, so that the date to access the auction page is more likely to come relatively late. Hence, the user thinks about bidding with a small number of accesses, so that it is possible to make the user feel impatient about bidding. Consequently, it is possible to encourage the user to make a bid.

Further, the system control unit 14 decides whether or not the request of the auction is received, acquires the mail opening date and time of the remind mail, compares the mail opening date and time and the second reference date and time set in advance, and makes the relative send time of the remind mail to be sent next come earlier than the relative send time of the remind mail of the closed auction when deciding that the request of the auction page is not received and the mail opening date and time comes later than the second reference date and time.

Consequently, the relative send time of the remind mail comes early, so that the date and time when the user opens the remind mail comes relatively early. Consequently, it is possible to give the user the time to browse the auction page. Consequently, it is possible to encourage the user to make a bid.

Further, the system control unit 14 make the relative send time of the remind mail to be sent next come a time corresponding to the difference between the mail opening date and time and the second reference date and time or more earlier than the relative send time of the remind mail of the closed auction, so that it is possible to reliably give the time to browse the auction page.

Furthermore, the system control unit 14 compares the mail opening date and time and a date and time which comes before than the second anteriormost date and time when deciding that the request of the auction page is not received and the mail opening date and time comes earlier than the second reference date and time, and makes the relative send time of the remind mail to be sent next come later than the relative send time of the remind mail of the closed auction when the mail opening date and time comes earlier than the date which comes before the second anteriormost date and time.

Consequently, it is possible to make the relative send time of the remind mail come late, so that the date and time when the user opens the remind mail is more likely to come relatively late. Consequently, it is possible to make the user feel impatient about browsing the auction page while giving the user the time to browse the auction page. Consequently, it is possible to encourage the user to make a bid.

Further, the system control unit 14 make the relative send time of the remind mail to be sent next come a time corresponding to a difference between the mail opening date and time and the date and time which comes before the second anteriormost date and time or more later than the relative send time of the remind mail of the closed auction, so that it is possible to reliably make the user feel impatient about browsing the auction page.

Furthermore, the system control unit 14 calculates the bidding time based on the access histories and the bidding histories registered in the history DB 12*d*, and sets as the second reference date and time the date and time which comes the calculated bidding time or more before the end date and time of the auction.

Consequently, it is possible to accurately decide whether or not the user had time to browse the auction page.

In addition, the electronic mail client installed in the user terminal 2 may not have a mail opening notifying function and the electronic mail client may not have a function of executing a script in a HTML mail. In this case, even when the user opens the remind mail, a mail opening notice is not sent from the user terminal 2. In this case, processing in steps S65 to S70 is not executed. Further, the system control unit 14 may not set the sending scheduled date and time of the remind mail based on the mail opening date and time. That is, the system control unit 14 may not execute the processing in steps S64 and S70. In this case, the system control unit 14 does not need to generate a remind mail such that the user terminal 2 sends the mail opening notice.

Further, the system control unit 14 may execute only processing of making the relative send time T come early, and may not execute processing for making the relative send time T come late (steps S59 to S63 and S68 to S70). At least when the user does not have time to think about bidding or does not have time to browse an auction page, it is only necessary to give the user the time.

Further, in the first reference date and time setting processing and the second reference date and time setting processing, the system control unit 14 calculates the bidding time based on the access history and the bidding history of the target user, and sets the first reference date and time and the second reference date and time. However, the bidding time may be calculated based on, for example, an access history and a bidding history of a product of which genre matches with the product of the target auction. Further, the system control unit 14 may set a sending scheduled date and time of a remind mail for an auction which lists a product of which genre matches with the product of the target auction among auctions registered in a watch list by the target user. The bidding time varies per user in some cases because the bidding time varies per product genre. Hence, in the auction information DB 12*b*, auction information including a genre ID which is identification information of a genre of the listed product is registered. When registering the access history or the bidding history (steps S14 and 17), the system control unit 14 acquires the gene ID from the auction information associated with the auction ID. Further, the system control unit 14 registers a history including the acquired genre ID in the history DB 12*d*. When searching for the access history and the bidding history in the first reference date and time setting processing and the second reference date and time setting processing, the system control unit 14 searches for a history including the same genre ID as the genre ID of the target auction. Further, the system control unit 14 calculates the bidding time based on the searched history. Furthermore, in the watch list DB 12*c*, the relative send time of the remind mail is registered per product genre. In step S81 of the remind mail sending scheduled date and time setting processing, the system control unit 14 registers the relative send time T in the watch list DB 12*c* in association with the user ID of the target user and the genre ID of the target auction. Further, in steps S82 to S88, the system control unit 14 updates the sending scheduled date and time of the remaining mail of an auction which lists a product of the same genre as the genre of the product listed in the target auction among auctions registered in the watch list. Furthermore, the system control unit 14 may set the first reference date and time and the second reference date and time based on an access history and a bidding history about a product of which genre matches with a product of the target auction among access histories and bidding histories of the target user.

2. Second Embodiment

2-1. Outline of Configuration and Function of Auction System

First, a configuration of an auction system S2 according to a second embodiment will be described using FIG. 8.

Figure 8:
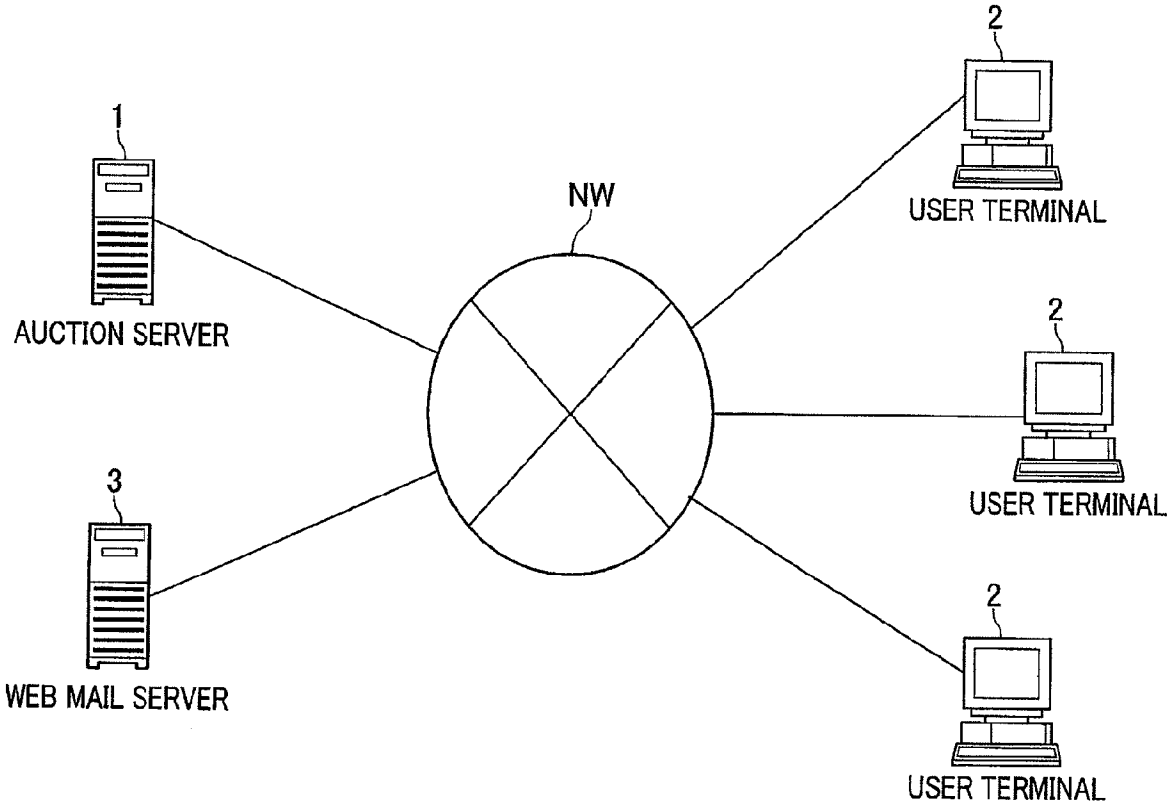
FIG. 8 is a view illustrating an example of a schematic configuration of an auction system S2 according to the embodiment.

FIG. 8 is a view illustrating an example of a schematic configuration of the auction system S2 according to the present embodiment. In FIG. 8, the same components as in FIG. 1 will be assigned the same reference numerals.

As illustrated in FIG. 8, in the auction system S2, a web mail server 3 is connected to a network NW in addition to an auction server 1 and a user terminal 2. The web mail server 3 is a server device which configures a web mail site which provides web mail server. A web mail is a type of an electronic mail client which allows a user to use the web mail through a browser when a user terminal 2 accesses the web mail server 3.

When the user is registered as a member at an auction site, an electronic mail account of the web mail is automatically given to the user. An account name of the account given to the user is, for example, identical to a user ID. The auction server 1 sets the electronic mail address of the user in the web mail, to the address of all electronic mails related to an auction including a remind mail and addressed to the user. Hence, electronic mails related to auctions of all users are collectively managed by the web mail server 3. When accessing the web mail server 3, the auction server 1 can acquire a mail opening date and time of a remind mail without using a mail opening function installed in the user terminal 2 or a HTML mail. Further, the auction server 1 can acquire a reception status of an electronic mail of each user from the web mail server 3.

2-2. Configuration and the Like of Web Mail Server

Next, a configuration and the like of the web mail server 3 will be described using FIGS. 9 and 10.

Figure 9:
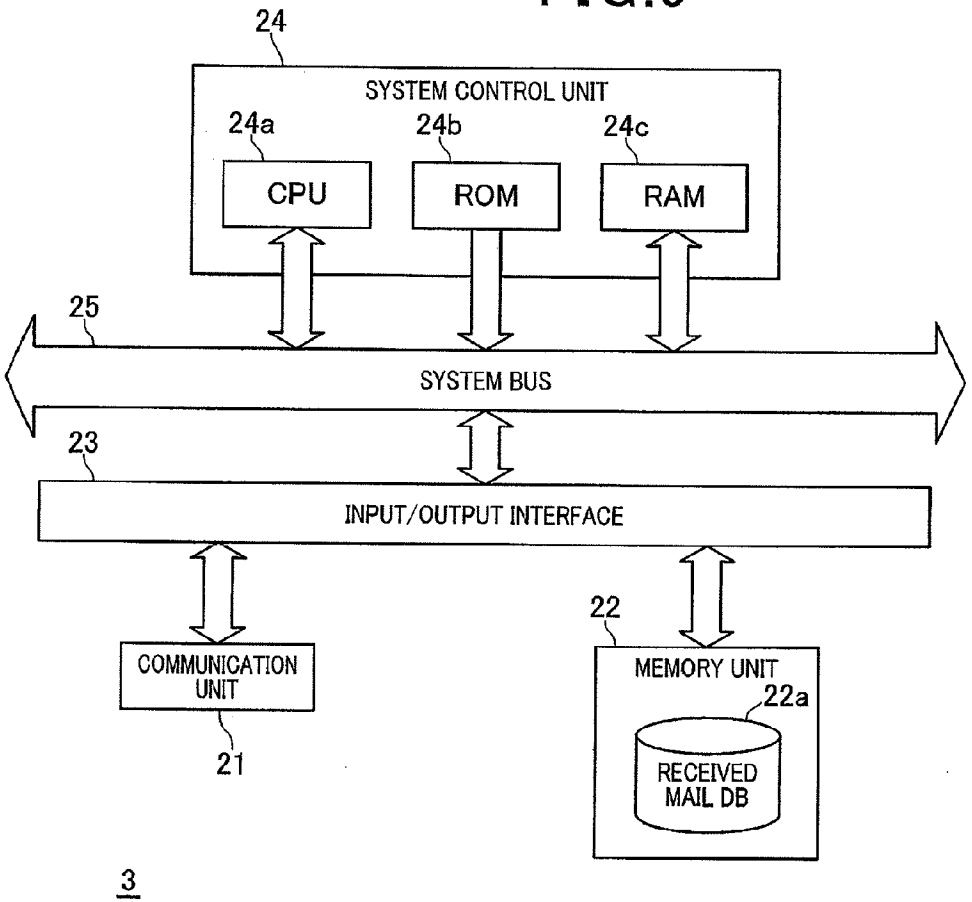
FIG. 9 is a block diagram illustrating an example of a schematic configuration of a web mail server 3 according to the embodiment.

FIG. 9 is a block diagram illustrating an example of a schematic configuration of the web mail server 3 according to the present embodiment. Further, FIG. 10A is a view illustrating an example of content registered in a received mail DB 22*a*. Furthermore, FIG. 10B is a view illustrating an example of content set to date and time record information.

As illustrated in FIG. 9, the web mail server 3 has a communication unit 21, a memory unit 22, an input/output interface 23 and a system control unit 24. Further, the system control unit 24 and the input/output interface 23 are connected through a system bus 25.

The communication unit 21 connects to the network NW to control communication states with, for example, the auction server 1 and the user terminals 2.

The memory unit 22 is configured by, for example, a hard disk drive. In this memory unit 22, the received mail DB 22*a* is constructed. In the received mail DB 22*a*, information related to an electronic mail (referred to a "received mail" below) addressed to the user of the web mail is registered. More specifically, as illustrated in FIG. 10A, in the received mail DB 22*a*, a user ID of the user to which a received mail is addressed, a message ID of the received mail, data and time of the received mail and a mail opening date and time of the received mail are associated and registered per received mail. In addition, although information related to an electronic mail sent from a user of a web mail is also registered in the memory unit 22, this information will not be described.

Meanwhile, as illustrated in FIG. 10B, in date and time record information registered in the watch list DB 12*c* of the auction server 1, only the auction ID and the message ID may be set and a send date and time and a mail opening date and time of a remind mail may not be set. This is because these pieces of information can be acquired from the received mail DB 22*a*. In addition, the configuration of the auction server 1 is basically the same as a configuration in the first embodiment.

Further, in the memory unit 22, various items of data such as HTML document, XML document, image data, text data and electronic document which configure webpages of a web mail site are stored.

Furthermore, in the memory unit 22, an operating system, a WWW server program and a SMTP server program are stored.

The input/output interface 23 performs interface processing between the communication unit 21 and the memory unit 22, and the system control unit 24.

The system control unit 24 has, for example, a CPU 24*a*, a ROM 24*b* and a RAM 24*c*. Further, when the CPU 24*a* reads and executes an auction managing program, the system control unit 24 performs integrated control of the entire web mail server 3.

In addition, the auction server 1 and the web mail server 3 may configure an integrated server device.

2-3. Operation of Auction System

Next, differences of an operation of the auction system S2 from an operation of the auction system S1 in the first embodiment will be described.

In step S7 illustrated in FIG. 4, a system control unit 14 of the auction server 1 associates and registers an auction ID of an auction A and a message ID of a remind mail as date and time record information in the watch list DB 12*c*. In this case, the system control unit 14 may not record a send date and time of the remind mail. Further, in step S8, when a user X performs an operation of opening the remind mail, the web mail server 3 registers a mail opening date and time in the received mail DB 22*a*. Hence, processing in steps S9 and S10 is not executed.

In step S51 of remind mail sending scheduled date and time setting processing illustrated in FIG. 5, the system control unit 14 of the auction server 1 acquires a send date and time and a mail opening date and time of the remind mail from the web mail server 3. More specifically, the system control unit 14 sends a request including a user ID of a target user and a message ID set to the acquired date and time record information, to the web mail server 3. The system control unit 24 of the web mail server 3 acquires a received mail associated with a user ID and a message ID set to the received request, and a mail opening date and time from the received mail DB 22*a*. Further, the system control unit 24 acquires a send date of the acquired received mail. Furthermore, the system control unit 24 sends the acquired send date and time and mail opening date and time to the auction server 1. Thus, the system control unit 14 of the auction server 1 acquires the send date and time and the mail opening date and time of the remind mail.

As described above, the present embodiment can provide the same effect as that of the first embodiment. Further, it is possible to reliably acquire the mail opening date and time of the remind mail.

In addition, in each of the above embodiments, the auction server 1 calculates a bidding time based on an access history and a bidding history, and sets a first reference date and time and a second reference date and time based on the bidding time. However, for example, an administrator may set in advance at least one of the first reference date and time and the second reference date and time. Further, the first reference date and time and the second reference date and time may be the same. Furthermore, the first setting time and the second setting time may be the same. Still further, the first anteriormost time and the second anteriormost time may be the same.

Moreover, the present invention is applied to an auction in each of the above embodiments. However, as long as an application deadline to purchase a product is set to transaction, the transaction to which the present invention is applicable is not limited to an auction. That is, the present invention is applicable not only to an Internet auction but also to, for example, online shopping. A transaction form to which an application deadline to purchase a product is set includes, for example, group purchase, limited time sales and time sale. The group purchase is a transaction form in which, when, for example, the number of products ordered in an application deadline is greater, a unit price to purchase the product becomes cheaper or, when an application to purchase a predetermined number of products is made within the application deadline, the transaction of the product is done. The limited time sales are a transaction form in which a sales period is set. The group purchase may be regarded as one form of the limited period sales. According to the limited period sales, it is possible to purchase a product which cannot be usually purchased or, if a product is purchased within a sales period, a purchase unit price becomes cheaper or a purchase bonus is given. The purchase bonus is, for example, a bonus, or a point or a coupon which can be allotted to payment of a product at online shopping. The time sale is a limited period sales in which, for example, the sales period is set to 24 hours or less. According to the transaction form in which an application deadline to purchase a product is set, at, for example, an online shopping site, a user accesses a webpage which lists information about a product which is a target of transaction for which a purchase application deadline is set, and registers this product in a watch list. An online shopping server device sends a remind mail regarding the product registered in the watch list and addressed to the registered user. This remind mail is an electronic mail which notifies the application deadline to purchase the product. In the body of the remind mail, for example, the application deadline and the URL of the webpage of the product are described. Further, upon online shopping, when a user performs an operation of determining an application to purchase a product at a site, a request for settling the application is sent from a terminal device to the online shopping server device. This request corresponds to application information in the present invention. The online shopping server device may perform processing of setting a sending scheduled date and time of a remind mail in the same way as in an auction.

REFERENCE SIGNS LIST

1 Auction server
2 User terminal
3 Web mail server
11 Communication unit
12 Memory unit
12*a* Member information DB
12*b* Auction information DB
12*c* Watch list DB
12*d* History DB
13 Input/output interface
14 System control unit
14*a* CPU
14*b* ROM
14*c* RAM
15 System bus
21 Communication unit
22 Memory unit
22*a* Received mail DB
23 Input/output interface
24 System control unit
24*a* CPU
24*b* ROM
24*c* RAM
25 System bus
NW Network
S1, S2 Auction system

The invention claimed is:

1. An electronic mail sending device comprising:

a sending unit that sends a first electronic mail which notifies a user of a terminal device of a first application deadline in a transaction for which the first application deadline to purchase a product is set, and which includes link information to a webpage which lists information about the product to be traded; and a setting unit that, when application information is not received from the user of the terminal device by the first application deadline, and when an access time, which is a time when the terminal device accesses the webpage indicated by the link information included in the first electronic mail, comes later than a reference time, which comes a predetermined period of time before the first application deadline, sets a send time of a second electronic mail to be sent next such that a first time interval between the send time of the second electronic mail to be sent next by the sending unit and a second application deadline to be notified by the second electronic mail to be sent next is longer than a second time interval between a send time of the first electronic mail sent by the sending unit and the first application deadline notified by the first electronic mail.

2. The electronic mail sending device according to claim 1, wherein, when the application information is not received by the first application deadline, and the access time comes later than the reference time, the setting unit sets the send time of the second electronic mail to be sent next such that the first time interval is longer than the second time interval by a period of time corresponding to or more than a difference between the access time and the reference time.

3. The electronic mail sending device according to claim 1, wherein, when the application information is not received by the first application deadline and the access time comes earlier than a time which comes a predetermined first period of time before the reference time, the setting unit sets the send time of the second electronic mail to be sent next such that the first time interval is shorter than the second time interval.

4. The electronic mail sending device according to claim 3, wherein, when the application information is not received by the first application deadline, and the access time comes earlier than the time which comes the first period of time before the reference time, the setting unit sets the send time of the second electronic mail to be sent next such that the first time interval is shorter than the second time interval by a period of time corresponding to or more than a difference between the time which comes the first period of time before the reference time, and the access time.

5. The electronic mail sending device according to claim 1, further comprising:

a first calculating unit that calculates a time from the access to the webpage to the application to purchase the product, based on a history of a user of an address of the first electronic mail sent by the sending unit, among histories stored in a memory unit that stores a history of an access to a webpage which lists information about the product to be traded and a history of an application to purchase a product; and a first time setting unit that sets, as the reference time, a time which comes a period of time calculated by the first calculating unit or more before the first application deadline notified by the first electronic mail sent by the sending unit, wherein:

the setting unit sets the send time of the second electronic mail to be sent in which an address of a user matches with the first electronic mail sent by the sending unit.

6. The electronic mail sending device according to claim 1, further comprising:

a second calculating unit that calculates a time from the access to the webpage to the application to purchase the product, based on a history of a product whose type matches with the product whose application deadline is notified by the first electronic mail sent by the sending unit, among histories stored in a memory unit that stores a history of an access to a webpage which lists information about the product to be traded and a history of an application to purchase a product; and a second time setting unit that sets, as the reference time, a time which comes a period of time calculated by the second calculating unit or more before the first application deadline notified by the first electronic mail sent by the sending unit, wherein:

the setting unit sets the send time of the second electronic mail to be sent next in which a type of a product whose application deadline is notified matches with the first electronic mail sent by the sending unit.

7. The electronic mail sending device according to claim 1, wherein, when the application information is not received by the first application deadline, the access time comes earlier than the reference time, and the terminal device accesses the webpage a plurality of times, the setting unit sets the send time of the second electronic mail to be sent next such that the first time interval is shorter than the second time interval.

8. The electronic mail sending device according to claim 1, wherein, when the terminal device does not access the webpage, and a mail opening time when the first electronic mail is opened comes later than a second reference time which comes a predetermined period of time before the first application deadline, the setting unit sets the send time of the second electronic mail to be sent next such that the first time interval is longer than the second time interval.

9. The electronic mail sending device according to claim 8, wherein, when the terminal device does not access the webpage, and the mail opening time comes later than the second reference time, the setting unit sets the send time of the second electronic mail to be sent next such that the first time interval is longer than the second time interval by a period of time corresponding to or more than a difference between the mail opening time and the second reference time.

10. The electronic mail sending device according to claim 8, wherein, when the terminal device does not access the webpage, and the mail opening time comes earlier than a time which comes a predetermined second period of time before the second reference time, the setting unit sets the send time of the second electronic mail to be sent next such that the first time interval is shorter than the second time interval.

11. The electronic mail sending device according to claim 10, wherein, when the terminal device does not access the webpage, and the mail opening time comes earlier than the time which comes the second period of time before the second reference time, the setting unit sets the send time of the second electronic mail to be sent next such that the first time interval is shorter than the second time interval by a time corresponding to or more than a difference between the mail opening time and the time which comes the second period of time before the second reference time.

12. The electronic mail sending device according to claim 8, further comprising:

a third calculating unit that calculates a time from the access to the webpage to the application to purchase the product, based on a history of a user of an address of the first electronic mail sent by the sending unit, among histories stored in a memory unit that stores a history of an access to a webpage which lists information about the product to be traded and a history of an application to purchase a product; and a third time setting unit that sets, as the second reference time, a time which comes the time calculated by the third calculating unit or more before the first application deadline notified by the first electronic mail sent by the sending unit, wherein:

the setting unit sets the send time of the second electronic mail to be sent next in which an address of a user matches with the first electronic mail sent by the sending unit.

13. The electronic mail sending device according to claim 8, further comprising:

a fourth calculating unit that calculates a time from the access to the webpage to the application to purchase the product, based on a history of a product whose type matches with the product whose application deadline is notified by the first electronic mail sent by the sending unit, among histories stored in a memory unit that stores a history of an access to a webpage which lists information about the product to be traded and a history of an application to purchase a product; and a fourth time setting unit that sets, as the second reference time, the-time which comes the time calculated by the fourth calculating unit or more before the first application deadline notified by the first electronic mail sent by the sending unit, wherein:

the setting unit sets the send time of the second electronic mail to be sent next in which a type of a product whose application deadline is notified matches with the first electronic mail sent by the sending unit.

14. A send time setting method in an electronic mail sending device that sends a first electronic mail which notifies a user of a terminal device of a first application deadline in a transaction for which the first application deadline to purchase a product is set, the send time setting method comprising:

a sending step of sending the first electronic mail which includes link information to a webpage which lists information about the product to be traded; and a setting step of, when application information is not received from the user of the terminal device by the first application deadline, and when an access time, which is a time when the terminal device accesses the webpage indicated by the link information included in the first electronic mail, comes later than a reference time which comes a predetermined period of time before the first application deadline, setting a send time of a second electronic mail to be sent next such that a first time interval between the send time of the second electronic mail to be sent next in the sending step and a second application deadline to be notified by the second electronic mail to be sent next is longer than a second time interval between a send time of the first electronic mail sent in the sending step and the first application deadline notified by the first electronic mail.

15. A non-transitory recording medium having a computer-readable send time setting program recorded thereon that causes a computer included in an electronic mail sending device that sends a first electronic mail which notifies a user of a terminal device of a first application deadline in a transaction for which the first application deadline to purchase a product is set, to function as:

a sending unit that sends the first electronic mail which includes link information to a webpage which lists information about the product to be traded; and a setting unit that, when application information is not received from the user of the terminal device by the first application deadline, and when an access time, which is a time when the terminal device accesses the webpage indicated by the link information included in the first electronic mail, comes later than a reference time which comes a predetermined period of time before the first application deadline, sets a send time of a second electronic mail to be sent next such that a first time interval between the send time of the second electronic mail to be sent next by the sending unit and a second application deadline to be notified by the second electronic mail to be sent next is longer than a second time interval between a send time of the first electronic mail sent by the sending unit and the first application deadline notified by the first electronic mail.

* * * * *